US011221193B2

(12) United States Patent
Rice et al.

(10) Patent No.: US 11,221,193 B2
(45) Date of Patent: Jan. 11, 2022

(54) FIREARM ACCESSORY AND METHOD THEREOF

(71) Applicant: Switch Grip, LLC, Massillon, OH (US)

(72) Inventors: Michael Christopher Rice, Massillon, OH (US); Daniel Edward Caldwell, III, Massillon, OH (US); Shane Matthew Tully, Massillon, OH (US)

(73) Assignee: SWITCH GRIP LLC, Massillon, OH (US)

( * ) Notice: Subject to any disclaimer, the term of this patent is extended or adjusted under 35 U.S.C. 154(b) by 0 days.

(21) Appl. No.: 17/018,723

(22) Filed: Sep. 11, 2020

(65) Prior Publication Data

US 2021/0164754 A1 Jun. 3, 2021

Related U.S. Application Data

(60) Provisional application No. 62/899,964, filed on Sep. 13, 2019.

(51) Int. Cl.
*F41C 23/16* (2006.01)
*F41C 27/16* (2006.01)

(52) U.S. Cl.
CPC ..... *F41C 27/16* (2013.01); *F41C 23/16* (2013.01)

(58) Field of Classification Search
CPC ..... F41C 27/16; F41C 27/00; F41C 23/16; F41C 23/22; F41B 13/08
(Continued)

(56) References Cited

U.S. PATENT DOCUMENTS 545,528 A 9/1895 Paul
1,023,741 A 4/1912 Kreith
(Continued)

FOREIGN PATENT DOCUMENTS

CA 2579060 3/2006
CN 1195105 10/1998
(Continued)

OTHER PUBLICATIONS

Gripknife.com as captured by The Internet Archive; https://web.archive.org/web/20180822075749/http://gripknife.com:80/, "Gripknife", captured Aug. 22, 2018.
(Continued)

*Primary Examiner* — Michael D David
(74) *Attorney, Agent, or Firm* — Sand, Sebolt & Wernow Co., LPA

(57) ABSTRACT

A firearm accessory is operable in two modes. A first mode in which the firearm accessory is coupled, at least indirectly, to a firearm to define a foregrip. In the first mode, a blade on the accessory is in a sheathed position. A second mode in which the firearm is disconnected from the firearm to define a knife. In the second mode, the blade is in an extended position. In each mode and position, the tip of the blade is vertically above the upper end of the grip body. The firearm accessory has prongs that connect the grip body to an attachment mechanism or coupler. Within the coupler are flexible liner locks that have sloped protrusions that engage recess in the blade to lock the blade in the extend position. The liner locks may be flexibly unlocked by depressing a button carried by the grip body.

20 Claims, 21 Drawing Sheets

(58) Field of Classification Search
USPC ..... 42/53, 72, 71.01, 71.02, 106
See application file for complete search history.

(56) References Cited

U.S. PATENT DOCUMENTS

| | | | | |
|---|---|---|---|---|
| 1,231,058 | A | 6/1917 | Pansa | |
| 2,805,507 | A | 9/1957 | Buquor | |
| 5,594,967 | A | 1/1997 | Morton et al. | |
| 5,924,233 | A | 7/1999 | Strobel | |
| 6,209,250 | B1 | 4/2001 | Mills | |
| 6,389,729 | B2 | 5/2002 | Rauch et al. | |
| 7,568,304 | B1 | 8/2009 | Moody et al. | |
| 8,196,328 | B2 | 6/2012 | Simpkins | |
| 8,650,791 | B2 | 2/2014 | Williams | |
| 8,661,723 | B2 | 3/2014 | Emde et al. | |
| 8,984,789 | B2 | 3/2015 | Adcock, Jr. | |
| 9,182,194 | B2 * | 11/2015 | Moore | F41G 11/003 |
| 9,228,796 | B2 * | 1/2016 | Adcock, Jr. | A01G 22/00 |
| 9,234,722 | B2 | 1/2016 | Rice et al. | |
| 9,389,044 | B2 * | 7/2016 | Rice | F41C 23/16 |
| 10,247,520 | B2 * | 4/2019 | Manly | F16B 21/186 |
| 11,035,647 | B2 * | 6/2021 | Brown | F41C 27/16 |
| 2006/0162224 | A1 | 7/2006 | Connal | |
| 2007/0271832 | A1 | 11/2007 | Griffin | |
| 2009/0133309 | A1 | 5/2009 | Cahill | |
| 2010/0018101 | A1 | 1/2010 | Moody et al. | |
| 2010/0132239 | A1 | 6/2010 | Moody et al. | |
| 2011/0173862 | A1 | 7/2011 | Williams | |
| 2014/0182182 | A1 | 7/2014 | Adcock, Jr. | |
| 2014/0215884 | A1 | 8/2014 | Adcock, Jr. | |
| 2014/0230303 | A1 | 8/2014 | Rice | |
| 2014/0338245 | A1 | 11/2014 | Lanasa et al. | |
| 2016/0102939 | A1 | 4/2016 | Rice et al. | |

FOREIGN PATENT DOCUMENTS

| | | |
|---|---|---|
| DE | 3222001 | 12/1983 |
| GB | 191514863 | 9/1916 |
| GB | 571902 | 9/1945 |
| IL | 239724 | 8/2018 |
| WO | 2014106250 | 7/2014 |

OTHER PUBLICATIONS http://www.m34tactical.com/raptor.html, "Raptor Dagger", printed Jun. 12, 2013, website is undated but inventor believes the website is older than May 14, 2013.

http://www.flickr.com/photos/48470964@N002/4442555408, pimpmygun.doctornoob.com, printed Jun. 12, 2013, website is undated but inventor believes the website is older than May 14, 2013 (unable to print original website as site no longer exists).

http://flickr.com/photos/48470964@n02/4444306510/in/photostream, pimpmygun.doctornoob.com, printed Jun. 12, 2013, website is undated but inventor believes the website is older than May 14, 2013 (unable to print original website as site no longer exists).

www.everydaynodaysoff.com/2012/07/05/bringing-a-knife-to-a-gunfight/, "Bringing a Knife to a Gunfight", author unknown, printed Jun. 12, 2013, website is undated but inventor believes the website is older than May 14, 2013.

www.amazon.com, "Kubaton 4 In. Black Keychain with Concealed Knife", printed Jun. 12, 2013, website is undated but inventor believes the website is older than May 14, 2013.

www.ar15.com, "Samson Knives for The AR15 Grip with Pics", printed Jun. 12, 2013, website is undated but inventor believes the website is older than May 14, 2013.

* cited by examiner

FIREARM ACCESSORY AND METHOD THEREOF

CROSS REFERENCE TO RELATED APPLICATIONS

This disclosure claims priority to U.S. Provisional Patent Application Ser. No. 62/899,964, filed on Sep. 13, 2019, the disclosure of which is incorporated herein by reference.

TECHNICAL FIELD

The present disclosure relates generally to a firearm accessory, namely, an accessory that can be used in two modes, a first mode as a fore grip for a firearm and a second mode as a knife when disconnect from the firearm. More particularly, the present invention relates to a firearm fore grip that is a knife when disconnected from the firearm. Specifically, the present invention provides a blade that is stored or sheathed when the device is at least indirectly coupled to a firearm (sometimes via a rail and other times with another attachment device that connects the fore grip or grip body to the fire arm), and the blade is exposed in an extended position when the device is disconnected from the firearm.

BACKGROUND

Many knives have been designed and configured for self-defense and utilitarian purposes. Most of these knives comprise some type of blade attached to a grip. Some knives have even been configured to be convertible between an open and closed position, such as a pocket knife. Knives can also be used as a tool in combination with a firearm. For example, the blade can function as a hand tool, like a screw driver, for disassembling the components of the firearm.

The prior art reveals fore grips for firearms have incorporated accessories before. For example, the MVF-515 Modular Vertical Foregrip Laser Sight distributed by the Crimson Trace Corporation of Wilsonville, Oreg. provides a flashlight and a laser sight integrated into a vertical fore grip. Additionally, the STK90201 TAPCO intrafuse vertical grip distributed by The Country Shed of Roaring Spring, Pa. provides a vertical fore grip adapted to house batteries within the grip body.

The Applicant of this disclosure has had prior versions of a convertible knife that converts between a knife and a component of a firearm. Namely, their prior versions and iterations provided a knife that converted between a knife and a vertical or angled fore grip of a firearm, wherein the fore grip remains attached to a blade when removed from the firearm. However, the Applicant's previous versions of a fore grip that converts into a knife when disconnected from the firearm can still be improved upon. For reference, the Applicant's other references are: US 2014/0230303; U.S. Pat. Nos. 9,234,722; 9,389,044; US 2016/0102939; U.S. Pat. No. 8,984,789; US 2014/0182182; U.S. Pat. No. 9,228,796; US 2014/0215884; CA 2935631 (Canada); EP 2938958 (Europe); and IL 239724 (Israel), the entirety of each of which is incorporated by reference as if fully re-written herein.

SUMMARY

The Applicant has continued to update its designs and recognized that there continues to be a need in the art for new grip devices that, in addition to providing a more stable shot to improve accuracy of the firearm, also sheathes a knife, blade, or other firearm accessory. The present invention addresses these and other issues.

In one exemplary embodiment, a foregrip having a grip body with a sheathed or stored blade includes a mount (or coupler or attachment mechanism) that holds a portion of the blade above the grip body when coupled to a firearm. This allows for the knife to be at least partially sheathed. This also means that the knife or blade does not fully conceal within the grip body because about 1" of the blade is currently staying out (i.e., exterior) of the grip body when the blade is in the closed position. The grip body amy detaches from the coupler on a rail of the firearm via a release button located on the coupler/mount, not on the grip, and can be mounted into a variety of sheaths to serve a variety of purposes.

Another embodiment may have a fixed blade going into the sheath/mount/coupler to serve a similar foregrip/knife function. This could also allow other accessories to be attached to and from the mount with the press of the same mount release button. This is advantageous because accessories can be taken on and off faster than ever before. For example, someone could remove knife/foregrip or grip body and attach a bipod in just a couple seconds with the press of one button.

There may be a blade lock button located on the grip body/handle in the center opposite of the side where the blade locks are located. It may be a free-floating button, but could be held in place through a variety of ways. When the button is pressed, it pushes a pin that is in both the left and right sides of the knife frame which pushes liner locks backward so that the blade can then again collapse itself within the grip.

In one embodiment there may be a lock on both the left and right sides of the blade (could be combined as one lock though). It could be a flat piece of steel or other rigid material with a tapered notch (male) on the top of one end that is designed to fit into the female relief located on the bottom of the blade. Each lock connects to the frame at three (or more) vertical points of contact for maximum strength. The locks could be combined and made as one piece, in which case then the lock would have around six points of contact to the frame. The locks act as spring steel, bending backwards as the blade is deployed. When the blade reaches a certain point, the spring-loaded locks spring back into a resting position into notches pre-cut into the blade, preventing the blade from sliding back down into the frame. The blade locks are at rest in both the locked and unlocked positions. They only move when the blade is deployed and when you push the unlock button located on the grip handle. The locks also aid in guiding the blade straight while the blade is in motion. In this exemplary embodiment or another additional embodiment, the lock for the blade is in a linear cam and follower mechanical function.

In one embodiment, the blade may be deployed (i.e, moved from the sheated position to the extended position) by a compressed spring within the frame inside the knife handle/grip body that pushes the blade upwards. This may also be assisted by a magnet or rare-earth magnet located inside the mount. The magnet attracts to the tip of the blade, holding the blade in place until the blade is locked (or entering the locked and extended position) and the blade is eventually pulled off of the magnet as the blade makes its way out of the mount. Also, the magnet assists with the reentry of the blade into the mount/sheath. When the blade is within close proximity of the mount/sheath, the magnet will start to magnetically attract the blade, not only aligns the blade with the blade slot between two non-metallic inserts, but guides the blade into the sheath providing a smooth blade "re-entry" onto the mount. This also allows users to feel where the knife goes. This means users can keep eyes on threat(s) down range and use in dark environments. Also, the mount housing for the 1" top section of the blade squeezes that section of the blade to prevent the blade tip from making contact with the ceiling of the mount/coupler which could damage the tip and/or the mount. At the same time, this pressure also squeezes the top of the blade to aid in the blade deployment as well as aiding in holding the knife in place, possible preventing the knife/blade from falling, should be a failure in securing the blade to the mount.

In some embodiments, the grip body may be unidirectional. In other embodiments, grip body is reversible, meaning it can be mounted with the cutting edge facing down range or with the cutting edge facing toward you. This would be ideal for a double-edged blade, as well as the ability to mount the knife quickly in an emergency.

Other embodiments pay provide a grip body that may house another object less lethal, such as a Taser or a can of pepper spray or similar deterrent type substance. The mount may also be considered a hand-stop or a sheath/knife holder.

The blade has a secondary bevel/transition that aids in reducing friction against the blade locks during blade deployment or retraction. The blade may also have an embedded magnet as well to increase the power of the magnetic assistance. The blade may also have a hook/catch/notch that would attach to something in the mount to aid in the deployment.

It is a collapsible knife that uses a solid piece frame that houses the blade on three or more sides (left/right, front/back; top/bottom) rather than using thin steel plates known as "liners" to plate each side individually. For example, the frame/chassis is held together by a machined dovetail system. It is also designed to accommodate multiple styles of springs, such as round springs and magazine springs.

In another exemplary embodiment, there may be a hook and post type connection between the grip and the liner lock in the mount. This allows for a method of securing accessories forward of the magazine-well to a mounting device; by the utilization of the hooks and posts or another type of mechanical design, with one or more of the pieces being controlled by a push, pull, twist or similar action, of a button lever or other mechanism to release the accessory from the secured position on/off of the firearm.

Additionally, other embodiments provide cutting tools such as a knife attached forward of the trigger but rearward of the bayonet lug (only if applicable) that may or may not be used as a grip and it may or may not be vertical in orientation and may or may not be a retractable blade. May be a grip or another device that enables the insulation of a blade.

In another exemplary embodiment, there may be a foregrip, or something that can be used as a grip, even if unintended, that includes a cutting tool that may or may not be retractable, and attaches to a firearm via a type of mounting device which may be a grip in and of itself. The knife blade can detach via a button mechanism or no button at all or some other mechanism.

In another exemplary embodiment, there may be a cutting tool with a blade deployment mechanism (or at least one stage of the deployment mechanisms) not being located on the knife handle or blade itself.

In at least one of these embodiments, the mounting device could be labeled any number of things from a grip to a magazine-well, to a sheath, hand stop to its own handguard. Further, the mounting device may allow for accessories to be mounted in a variety of useful orientations.

In another exemplary embodiment, there may be a retractable cutting tool that uses a multi-piece frame, that with at least one of the pieces providing stability to the blade on more than one side, so that without the use of screws, that piece of frame provides immobility by contacting (or able to contact the blade on at least two sides in locked position)

In at least one of these embodiment a "Through-the-Frame Lock" is utilized. These provide for the ability to press, pull, or push a button type mechanism and manipulate the locks on the opposing side of the frame, directly or in directly, so that the blade can move freely or prevent the blade from moving freely.

When locks are at rest such as in the locked position the top of the locks are resting on or very near the bottom of the blade or on a cut out in the blade; while the bottom of the locks are resting on or very near the frame. Orientation may vary but the idea is that force travels from the blade to the locks down through the frame for maximum strength in the locked position. These locks can also control blade direction and speed of blade deployment and the stiffness of the Unlock button. Where the lock incorporates some type of resting on the frame or handle or other stable device to be used for support. Blade is touching at least 1 side of lock head (in this example the top), and the opposing side of lock head is touching at least 1 side of a foundation (in this example, the bottom).

Locks that lock the blade from the width of the blade as opposed to the side (thickness/cutting edges). Two or more locks controlled by one button. Locks that don't have to necessarily be under the blade but can be in, on, or partially or even fully through the blade.

Some other embodiments provide for a magnetic deployment. Here, the blade that uses magnets to deploy and or retract the blade into and or from the locked and unlocked positions. Or use of magnets to aid in a knife locking or unlocking.

Some other embodiments provide for friction and compression deployment of a collapsible knife. The blade may uses friction and/or compression such as tight/stretched/compressed rubber, plastic, metal, or another material, to deploy and or retract the blade into or from the locked and unlocked positions. The use of any mechanism toward the upper portion of the blade to deploy or assist in deploying the blade from its locked and unlocked positions—functioning by itself, or as it's pushed into or pulled away from mounting device.

There may be an anti-rattle spring steel built into the knife frame. When bent into the appropriate angle, this will prevent the knife from rattling against the frame; without the need for additional pieces. This spring steel could also be screwed onto the frame as an additional piece and operation.

Some embodiments may include a blade stop that requires no fasteners and is free-floating that can be made reversible and also acts as the slider for the knife, keeping it on track and aligned. Towards this end, there may also be a free-floating unlock button. This may also include an unlock button that can unlock locks on the opposing side of the blade.

The firearm accessory of the various embodiments device may attach to other platforms, in which users are doing on their own accord, such as using accessory as a vehicle gear shifter, and using accessory as the handle of a trekking pole, or fishing pole, as well as other various platforms in which people wish to have immediate access to a knife for some purpose. As such, the present disclosure encompasses a blade housed in the upper horizontal portion of a grip which may or may not be angled relative to a longitudinal axis of the platform.

In another embodiment, there may be a blade stored in the horizontal position, while attached to firearm, deployed via a pulling forward motion, or vertically released, as in downwardly for example while blade remains horizontal.

One exemplary embodiment provides a foregrip in the present disclosure has a blade that is moveable between an extracted position and a collapsed position. When the blade is in the extracted position, a pair of liner locks is used to engage the blade so as to lock it in the extracted position. Each liner lock is identical from the pair of liner locks and will be discussed individually for brevity; however, it is to be understood that the liner locks are mirror opposites of each other. Each liner lock includes an upper end and a lower end wherein the lower end is rigidly secured to the frame of the foregrip. The liner lock is a substantially elongated body extending from the lower end upwardly to its upper end. The liner lock may have a length greater than its width and greater than its thickness. The width of the liner lock may be greater than its thickness; as such, liner lock may be generally shaped as a planar elongated bar as best shown throughout the figures. In one particular embodiment, the liner lock may be bored or drilled with a plurality of small holes extending transversely through the thickness of the liner lock between first and second major surfaces. The plurality of holes or apertures may be formed generally in the shape of an S or may be configured to define an S-shaped configuration. The plurality of holes extending transversely through the thickness of the liner lock enable the liner lock to have a greater amount of flexibility so as to bend when the liner lock needs to release the blade from its locked position. Above the plurality of apertures is a locking protrusion that extends outwardly in a cantilevered manner from the first major surface of the liner lock. The locking protrusion may have a tapered surface defining a slope which enables the blade to ride over and push the liner lock or deflect it outwardly as the blade is moving outwardly to the extracted position. Then, when the blade is fully extracted, the liner locks, having a spring-like flexibility, moves backwardly so as to engage the locking protrusion with a complimentary aperture formed in the lower end of the blade. The locking protrusion extends through the aperture in the blade so as to lock it into place in the extracted position. Each liner lock has an upward inward extension, which extends inwardly towards the longitudinal axis of the foregrip. The upper extension is offset inwardly towards the longitudinal axis from the major longitudinal edge of the liner lock. The extension provides a seat or platform upon which a corresponding protrusion or nub on the release button engages when the operator desires to release the liner lock from its locked engagement with the blade. To release the liner lock from its engagement with the blade, the button on the grip is depressed to push the extensions away from the blade. The movement of the upper extensions away from the blade releases the protrusion locks from their engagement with the apertures at the lower end of the blade. When the protrusion locks are disengaged from the apertures on the lower end of the blade, the blade may be moved from the extracted position inwardly into the cavity defined by the grip body so as to collapse or retract the blade into the body for storage.

The housing is formed with stop blocks or walls so ensure that the blade and grip are only installed on the mount in a single direction. Stated otherwise, for safety purposes, the foregrip cannot be installed on the mount in a reverse direction. In this instance, the sharpened edge faces forwardly and the grip would not be able to be installed with the knife edge facing rearward towards the operator. The mount lock has downwardly extending hooks that ordinarily lock on to corresponding extensions or protrusions from the frame of the foregrip. Adjacent these extensions are the stop blocks that are molded as part of the grip body so as to contact the downwardly protruding hooks of the mount lock and prevent the knife from attaching with the mount in the reverse direction.

Within the mount or coupler or attachment mechanism, there are two inserts which straddle to retain the blade when the foregrip is mounted to the mount. The inserts may be coated with a rubber or other polymer-like material to ensure that the blade is securely retained through a frictional engagement with a polymer or rubber coating to the inserts. Additionally, one of the inserts may house, retain, or cover a magnet, such as a rare earth magnet, which assists in creating magnetic or other attracting forces to keep the tip of the blade in physical contact with the rubber coated insert. The magnet works to assist the tip of the blade into the correct position when the knife is being installed to the bottom portion of the mount. Additionally, the magnet assists with the extraction of the blade when the grip body is being pulled downwardly to extract the blade therefrom. The magnetic relationship between the rare earth magnet and the tip of the blade keeps the two engaged during the downward single action extraction motion of the blade from the grip body. Then once the knife is fully in the extracted position and the liner locks have locked the blade in the extracted position, the operator may continue pulling downwardly so as to overcome the magnetic force to release the knife from its magnetic engagement with the inserts positioned within the mount.

With continued reference to the mount, the mount has a downwardly flared opening that has a contour to act as a guide for the upper portion of the grip body. The downwardly flared opening has a lip or contour that retains the upper portion of the grip body. The shape of the grip is complimentary to the grip body such that an accidental push of the release button does not allow the grip body to release from the mount. Rather, the lip ensures a frictional interference fit between the grip body and the mount such that when the release button is depressed, additional physical force must be utilized to pull the grip body downwardly from the mount thereby overcoming the frictional engagement force of the lip relative to the grip body to ensure that the knife or blade is extracted therefrom. Additionally, the flared opening of the mount acts similar to a funnel when the knife is being placed into the mount and moved inwardly to the grip body. The flared opening of the mount funnels the grip body into a proper position such that regardless of the upward angle at which the operator is attempting to place the grip body into the knife, the connection will seat properly.

With continued reference to the mount and the release button, the release button must be depressed fully in order to extract the blade to the extracted position through its single action motion and downward extraction of the grip body from the mount. In order to prevent accidental release, the push button release must be depressed beyond the outer surface plane of the mount. This ensures that the foregrip were accidentally placed on a surface which would depress the release button flush with the outer surface of the mount, that the knife would still remain locked to the mount. Structurally, a spring is housed within the mount and operatively connected with the push button release and the seat of the push button release is structured such that the spring must be compressed in a manner to ensure that the outer surface of the push button extends inwardly beyond the outer plane of the mount to release the grip body from the mount.

In one particular aspect, an exemplary embodiment of the present disclosure may provide a method comprising: grasping a grip body having a blade in an extended position when the grip body is detached from a firearm, wherein the grip body has a first end and second end, wherein the blade extends outwardly from the first end of the grip body; moving a tip on the blade upwardly towards an attachment mechanism coupled the firearm; moving the tip through a portion of the attachment mechanism and continuing to apply an upward force to the grip body, wherein the upward force applied against the grip body causes the tip to pass through the portion of the attachment mechanism; coupling the grip body to the firearm via the attachment mechanism forward of the trigger; and retaining the blade in a sheathed position within the attachment mechanism within which the tip on the blade remains offset from the first end and exterior the grip body. This exemplary method or another exemplary method may provide wherein coupling the grip body to the firearm is accomplished by engaging at least one prong on the attachment mechanism with the grip body, wherein the tip of the blade is vertically above the two prongs in the sheathed position. This exemplary method or another exemplary method may provide moving the at least one prong in response to the upward force applied to the grip body. This exemplary method or another exemplary method may provide engaging two prongs on the attachment mechanism with an element carried by the grip body, wherein one prong is offset to a first side of the blade and a second prong is offset to a second side of the blade. This exemplary method or another exemplary method may provide wherein coupling the grip body to the firearm is accomplished by engaging two prongs on the grip body with the attachment mechanism, wherein the tip of the blade is vertically above the two prongs in the sheathed position This exemplary method or another exemplary method may provide flexing a liner lock inside the grip body.

In yet another aspect, an exemplary embodiment of the present disclosure may provide a method comprising: grasping a grip body having a first end and a second end, and connected to the grip body is a blade having a tip, wherein the blade extends outward from the first end and the tip is exterior the grip body when the blade and tip are in a sheathed position forwardly from a trigger inside an attachment mechanism coupled to the firearm when the grip body is coupled to the attachment mechanism; de-coupling the grip body from the attachment mechanism; moving the tip through a portion of the attachment mechanism and continuing to apply an outward force to the grip body, wherein the outward force applied to the grip body causes the tip to pass through the portion of the attachment mechanism; moving the tip on the blade away from the attachment mechanism that remains coupled the firearm; drawing the grip body away from the firearm such that the blade is in an extended position when the grip body is de-coupled from the firearm; wherein the blade extends outwardly from the first end of the grip body in the extended position. This exemplary method or another exemplary method may provide wherein decoupling the grip body from the firearm is accomplished by disengaging at least one prong on the attachment mechanism from the grip body, wherein the tip of the blade is vertically above the two prongs in the sheathed position. This exemplary method or another exemplary method may provide moving the at least one prong subsequent to the outward force applied to the grip body. This exemplary method or another exemplary method may provide disengaging two prongs on the attachment mechanism from a portion of the grip body, wherein one prong is offset to a first side of the blade and a second prong is offset to a second side of the blade. This exemplary method or another exemplary method may provide wherein decoupling the grip body to the firearm is accomplished by disengaging two prongs on the grip body with the attachment mechanism, wherein the tip of the blade is vertically above the two prongs in the sheathed position. This exemplary method or another exemplary method may provide flexing a liner lock inside the grip body to move from an unlocked position into a locked position in which the liner lock engages the blade adjacent a lower end of the blade in the extended position.

In another aspect, another exemplary embodiment of the present disclosure may provide a firearm accessory comprising: a grip body having a first end and a second end, wherein the grip body is adapted to operate in two modes: a first mode as a foregrip when the grip body is at least indirectly coupled to a firearm forwardly of a trigger and a second mode as a knife when the grip body is disconnected from the firearm; a blade coupled to the grip body, wherein the blade includes a tip, wherein the tip is exterior the first end of the grip body in both the first mode and the second mode; a coupler adapted to be coupled with the firearm; and two members that connect the grip body and the coupler when the grip body is in the first mode as a foregrip forwardly of the trigger, and the two members are disconnected relative to the grip body and the coupler when the grip body is in the second mode as a knife detached from the firearm. This exemplary embodiment or another exemplary embodiment may further provide wherein the two members are a first prong and a second prong. This exemplary embodiment or another exemplary embodiment may further provide wherein the first prong and the second prong are extend downwardly from the coupler when the coupler is coupled to the firearm forwardly of the trigger. This exemplary embodiment or another exemplary embodiment may further provide a magnet within the coupler adapted to be attracted to the blade when the grip body is in the first mode. This exemplary embodiment or another exemplary embodiment may further provide an insert formed from an elastomeric material defining a sloped wall adapted to contact the blade near the tip when the grip body is in the first mode; a recess defined by the insert, wherein the magnet is disposed within the recess. This exemplary embodiment or another exemplary embodiment may further provide at least one liner lock within the grip body adapted to lock the blade in an extended position in the second mode. This exemplary embodiment or another exemplary embodiment may further provide wherein the at least one liner lock is formed with a plurality of weakening apertures adapted to increase the flexibility of the liner lock. This exemplary embodiment or another exemplary embodiment may further provide wherein the blade is fixedly connected (i.e., a fixed blade knife) relative to the grip body.

In yet another aspect, an exemplary embodiment of the present disclosure may provide a firearm accessory is operable in two modes. A first mode in which the firearm accessory is coupled, at least indirectly, to a firearm to define a foregrip. In the first mode, a blade on the accessory is in a sheathed position. A second mode in which the firearm is disconnected from the firearm to define a knife. In the second mode, the blade is in an extended position. In each mode and position, the tip of the blade is vertically above the upper end of the grip body. The firearm accessory has prongs that connect the grip body to an attachment mechanism or coupler. Within the coupler are flexible liner locks that have sloped protrusions that engage recess in the blade to lock the blade in the extend position. The liner locks may be flexibly unlocked by depressing a button carried by the grip body. The blade may be either fixed blade or a retractable blade.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
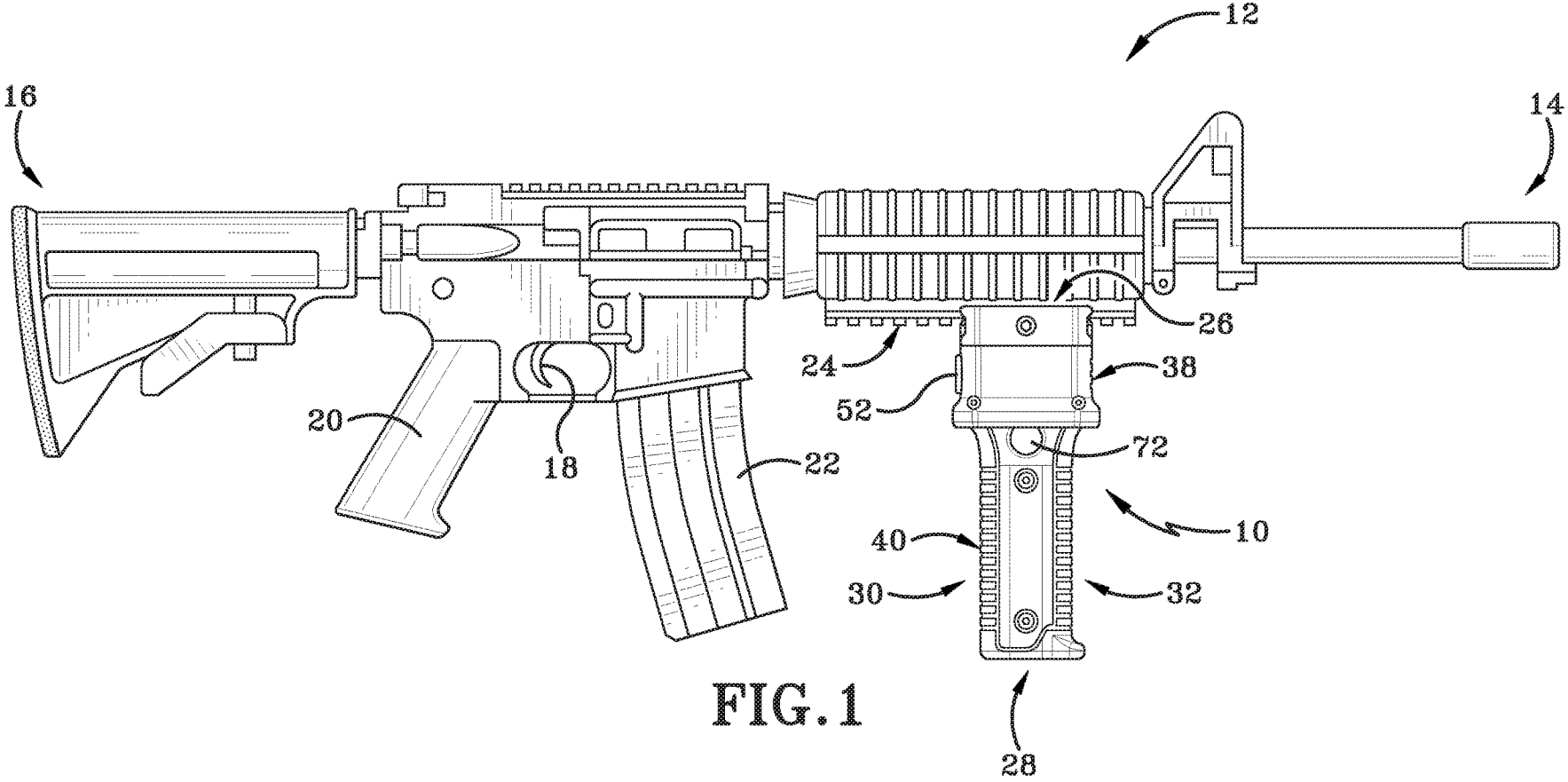
FIG. 1 is a side elevation view of an exemplary embodiment of a firearm accessory in accordance with one aspect of the present disclosure shown attached to a firearm.

FIG. 1 depicts a firearm accessory 10 in accordance with one aspect of the present disclosure. Firearm accessory 10 is coupled with a firearm 12 having a forward end 14 and a rear end 16. The firearm 12 defines a longitudinal direction extending from the forward end 14 to the rear end 16. When the firearm 12 is embodied as a rifle, the rear end 16 is defined by a butt of the gun/firearm and the forward end 14 is defined by a barrel through which a projectile or bullet is discharged. Further, when the firearm 12 is embodied as a rifle, it includes a trigger 18 and a rear grip 20 positioned rearward from the trigger 18. Firearm 12 may further include a magazine 22 positioned forwardly of the trigger 18. Although firearm 12 is embodied as a rifle in FIG. 1, it is to be understood that the firearm may be other types of firearms, such as handguns. In this situation, if embodied as a handgun, the rear grip 20 would be located rearward of the trigger 18 but there may be a magazine within the rear grip 20. Thus, it is to be understood that the firearm accessory 10 may be coupled to any type of firearm regardless of whether it is a handgun or a rifle-style firearm.

The firearm 12 may include a rail 24 positioned forwardly from the trigger 18. In one particular embodiment, rail 24 extends longitudinally along a portion of the firearm. The rail may be a Picatinny rail in one embodiment. As will be described in greater detail herein, the firearm accessory 10 is, according to one embodiment, designed to couple with the firearm 12 via rail 24. However, it is to be clearly understood that in versions of different embodiments in which the rail 24 may not be present, other manners and ways of coupling the firearm accessory 10 to firearm 12 are entirely possible. Thus, it is to be broadly construed that the firearm accessory 10 may be coupled to the firearm 12 in any number of ways regardless of whether it uses rail 24. However, in most embodiments, firearm accessory 10 is positioned forwardly of the trigger 18 regardless of the type of firearm that is used. For example, if firearm 12 were to be embodied as a handgun, a coupling device could couple the firearm accessory 10 to the handgun forwardly of its trigger 18. In this embodiment, there may be a coupler that connects the firearm to the firearm accessory 10, or in the inverse, there may be a coupler that couples the firearm accessory to the firearm 12.

Figure 12:
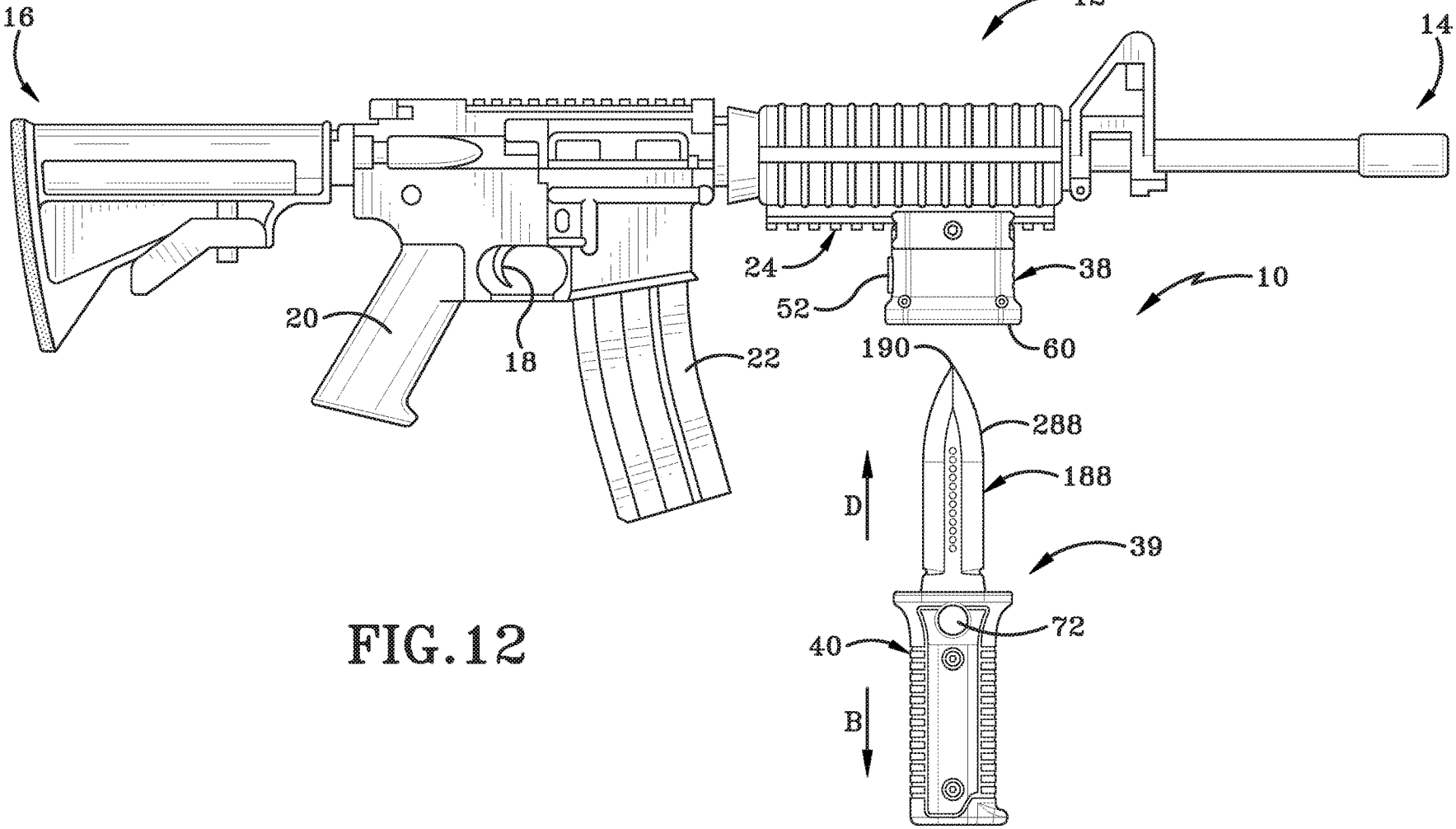
FIG. 12 is an operational side elevation view depicting movement of the grip body and blade relative to the firearm.

As will be detailed in greater detail herein, the firearm accessory 10 has two operating modes. Particularly, a first mode (depicted in FIG. 1) in which the firearm accessory is attached to the firearm 12 forwardly of trigger 18 to define a foregrip, and a second mode in which the grip body of the firearm accessory 10 is detached from the firearm 12 to define a knife 39 (FIG. 12). In the first mode, the firearm accessory 10 is in a sheathed position, and in the second mode the firearm accessory is in an extended position. In each mode or position, at least a portion of a blade extend outwardly from the grip body.

Figure 2:
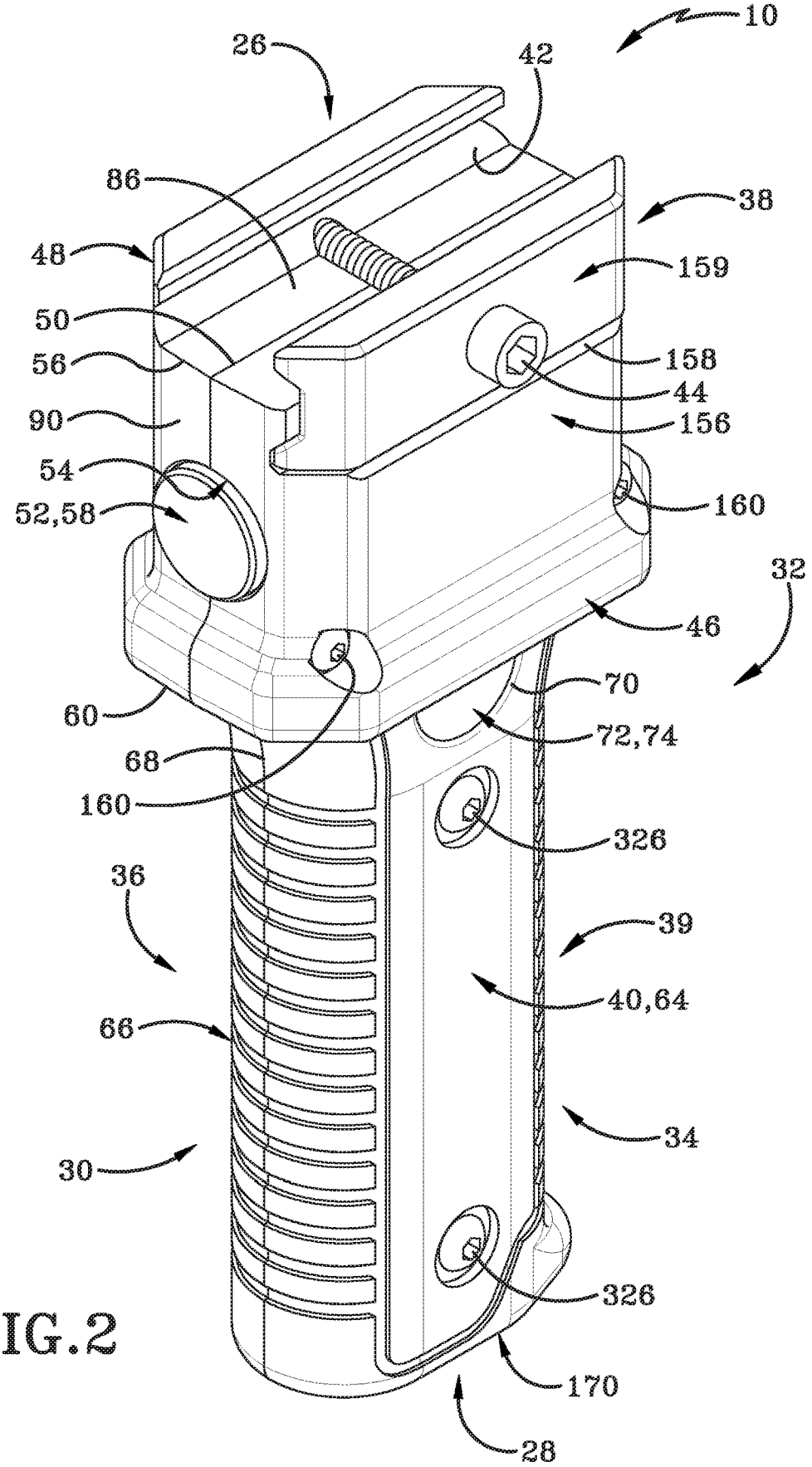
FIG. 2 is a top rear perspective view of the firearm accessory according to one embodiment of the present disclosure.

FIG. 2 depicts a top rear perspective view of firearm accessory 10. Firearm accessory 10 includes a top end 26 and a bottom end 28 defining a vertical direction therebetween. Firearm accessory 10 includes a rear end 30 opposite a forward end 32 which is aligned with the longitudinal direction of the firearm 12. Firearm accessory 10 further includes a first side 34 opposite a second side 36 defining a transverse direction therebetween that is perpendicular to the vertical direction and perpendicular to the longitudinal direction.

Broadly, firearm accessory 10 includes an attachment mechanism or coupler 38 and a grip body 40. Attachment mechanism 38 or coupler 38 defines the top 26 of the firearm accessory 10. More particularly, attachment mechanism or coupler 38 defines a longitudinally extending channel 42 that is shaped complementary to the rail 24 on firearm 12. Channel 42 is configured to slidably receive rail 24 therein to releasably attach the coupler 38 to the firearm 12. The transverse dimension of the channel 42 may be adjusted via screw 44 to tighten and loosen the attachment mechanism or coupler 38 relative to the longitudinal position on rail 24 of firearm 12. While the channel 42 is depicted as a dovetail channel, any channel that effectuates the coupling of the attachment mechanism 38 to rail 24 or the attachment to another portion of the firearm 12 are entirely possible. Further, while the screw 44 is embodied as one manner of tightening the attachment mechanism 38 to the firearm, other elements could be easily substituted to effectuate the coupling. For example, a quick release mechanism could be substituted for the screw 44.

In one particular embodiment, attachment mechanism 38 includes a first side portion 46 and a second side portion 48. The first side portion 46 and the second side portion 48 are aligned side by side to define a longitudinal parting line 50. When the first and second side portions 46, 48 are coupled together, a button 52 extends rearward from the attachment mechanism 38 through a circular aperture 54 that is defined by two semicircular edges on each respective side portion 46, 48. Each side portion 46, 48 includes a top rear edge 56 defining the rear end of channel 42. A rear vertical plane extends upwardly from rear edge 56. The rear vertical plane 346 (FIG. 10) is positioned forwardly from the major surface 58 of button 52 when the button 52 is in its normal resting position, as shown in FIG. 2.

As will be described in greater detail below, the attachment mechanism 38 may be also considered as a sheath inasmuch as, according to some embodiments, there may be a blade or a sharpened member within a portion of the attachment mechanism 38 or sheath 38 when the attachment mechanism 38 is coupled to firearm 12.

Attachment mechanism 38 may further include a lower edge 60 collectively defined by the first and second side portions 46, 48 when they are connected together. Lower edge 60 defines a portion of an opening 62 (FIG. 3A) that is configured to receive a portion of the grip body 40 therein. In one particular embodiment, the lower edge 60 defining opening 62 may have a unique unidirectional configuration that ensures that the grip body 40 is received within a portion of the attachment mechanism 38 so that it only fits in one direction. Stated otherwise, the configuration shown in FIG. 2 aligns the grip body with a forward end of the grip body always facing the forward direction. This precludes the grip body from accidentally being installed in reverse.

Figure 8:
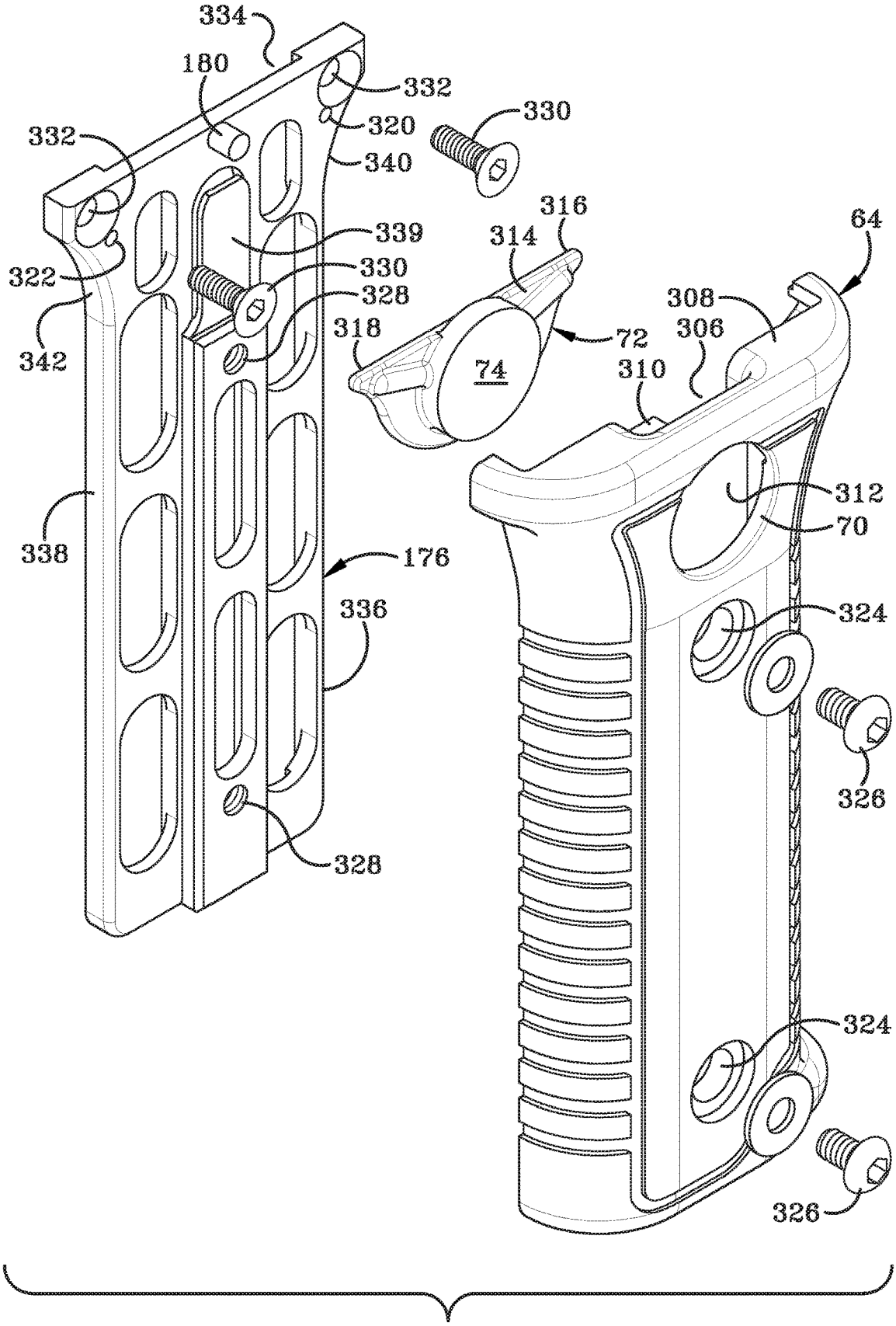
FIG. 8 is an exploded top perspective view of portions of the grip body.

With continued reference to FIG. 2, the grip body 40 includes a first side portion 64 and a second side portion 66. When the first and second side portions 64, 66 are connected together, they define a vertical parting line 68. As will be described in greater detail below, portions of the grip body 40 are configured to house a blade or other device therein. The first side portion 64 defines an edge 70 defining a transversely aligned opening 312 (FIG. 8). The transversely aligned 312 opening receives a second button 72 therein. Button 72 includes a major surface 74. Major surface 74 of button 72 is aligned in the longitudinal direction and substantially perpendicular to major surface 58 of button 52. As will be described in greater detail below, button 52 and button 72 have different operations. Namely, button 52 is used to release the grip body 40 from its releasable connection with the attachment mechanism 38. Button 72 is configured to unlock the blade from its extended position so that the blade may be inserted upwardly into the attachment mechanism 38 into a sheathed position so that a portion of the blade collapses down into the grip body 40.

Figure 3A:
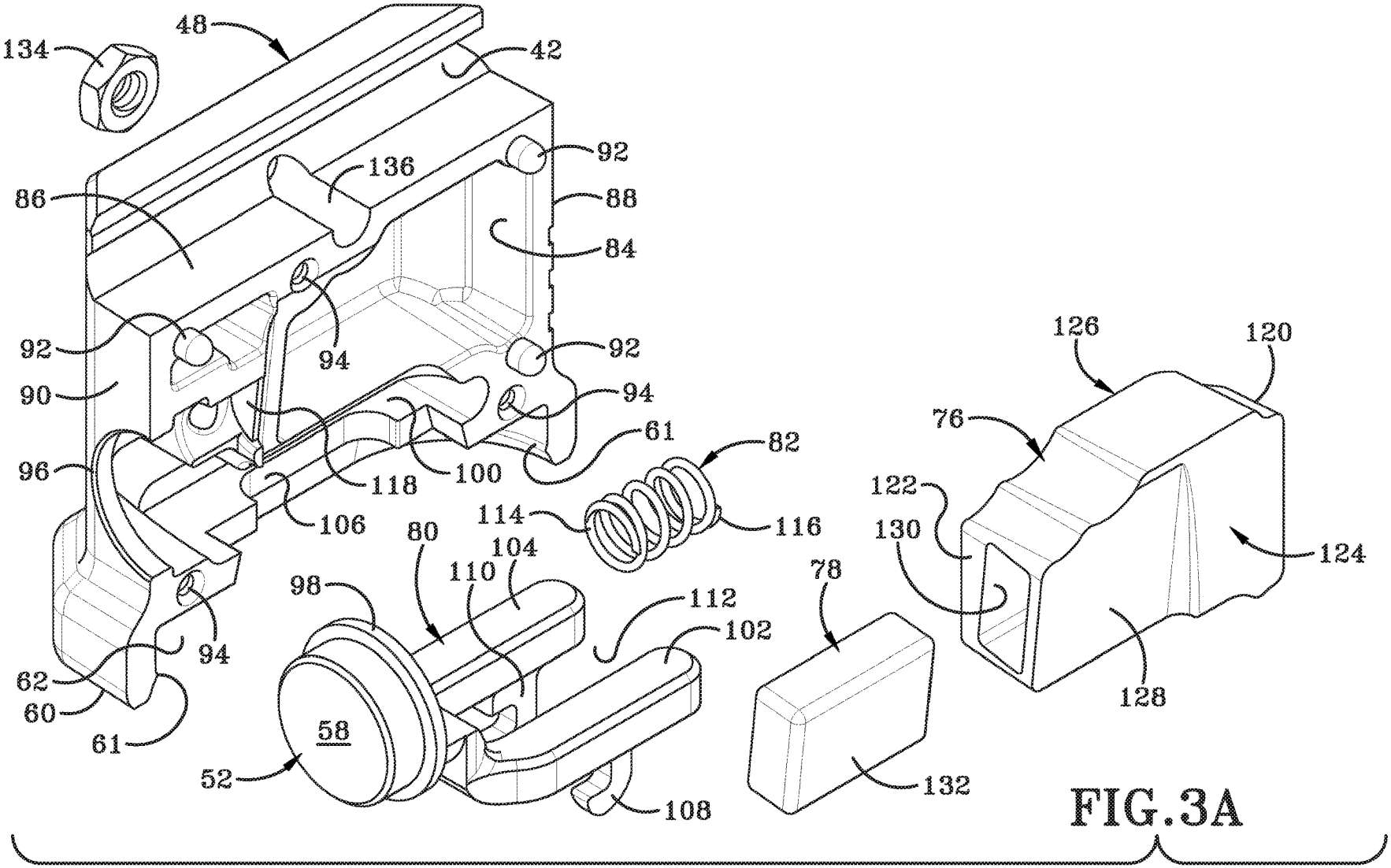
FIG. 3A is an exploded perspective view of components of an attachment mechanism for the firearm accessory.

FIG. 3A depicts an exploded perspective view of some components of the attachment mechanism or coupler 38. More particularly, the attachment mechanism 38 is shown with the first side portion 46 being removed. The internal components of the attachment mechanism are shown as including an insert 76, a magnet 78, a U-shaped member 80 coupled with the button 52, and a spring 82. The portions of the insert 76, the U-shaped member 80, and the spring 82 are disposed within portions of the second side portion 48 of the attachment mechanism 38. More particularly, the second side portion 48 defines a recess 84 that is shaped complimentary to the insert 76. In one particular embodiment, the recess 84 is disposed below a top wall 86 defining a lower portion of channel 42. The recess may be disposed generally towards the forward end of the second portion 48. The forward end of second portion 48 is defined by a vertical front wall 88 and the rear end is defined by the rear vertical wall 90. Second portion 48 may have transversely extending protrusions 92 which are configured to fit within complementary holes in the first side portion 46. Similarly, while not shown, the first portion 46 may have protrusions 92 that fit within holes in the second side portion 48. This allows the first and second side portions 46, 48 to fit together and be connected in a manner in which they collectively define the parting line 50. Second portion 48 may further include threaded apertures 94 that receive screws 160 (FIG. 4) The circular edge 54 shown in FIG. 2 is defined partially by the rear semicircular edge 96 on second portion 48. The semicircular edge 96 bounds the circular aperture and receives the button 52 therein. Button 52 may include an annular collar 98. The annual collar 98 has a larger diameter than the circular edge 96. As such, the collar sits forwardly from the semicircular edge 96 and prevents the button 52 from protruding too far rearward and acts as a stop block.

Below the recess 84 in the second portion 48 is a slot 100. Slot 100 is sized and shaped to receive the U-shaped member 80 therein. More particularly, U-shaped member 80 includes a first leg 102 and a second leg 104. The second leg 104 resides within and is slidably received by slot 100 in the second portion 48. Below the slot 100 is a sub-slot 106. The sub-slot 106 is configured to receive one of the two downwardly extending prongs from the U-shaped member. Namely, a first prong 108 extends downwardly from the first leg 102 and a second prong 110 extends downwardly from the second leg 104. The first and second prongs 108, 110 are configured to connect with metal pins or bars on the grip body 40 as will be described in greater detail herein. A portion of the blade extends between the space or gap 112 defined between the first leg 102 and the second leg 104.

Spring 82 includes a rear end 114 and a forward end 116. The forward end 116 of spring 82 connects with a seat 118 which is positioned rearward of recess 84. The rear end 114 of spring 82 couples with a rear end of the button 52 above the first and second legs 102, 104 of the U-shaped member 80. The spring 82 provides biasing force to urge the button into a locked position such that the button may be depressed in a longitudinal direction against the biasing force or spring 82 to unlock the grip body 40 from the attachment mechanism 38 when the compression coil spring 82 is compressed in the longitudinal direction.

With continued reference to FIG. 3A, the insert 76 may include a forward end 120 and a rear end 122. The insert 76 may include a first side surface 124 and a second side surface 126. The first side surface 124 includes a blade contact section which may be a sloped wall 128 that is upwardly tapered that is configured to receive and sheath an upper tip of the blade as will be described in greater detail below. While the blade contact section is preferably the sloped wall 128, the blade contact section may have differing configurations. The insert 76, according to one exemplary embodiment, may be formed from an elastomeric material, such as a polymer or a rubber. This allows the sloped wall 128 to frictionally grip and contact the upper portion or tip of the blade when the blade is sheathed within the attachment mechanism 38. Alternatively, the insert 76 may be formed from another material and the sloped wall 128 may be coated with an elastomeric or other polymer material. The rear wall 122 may define an opening 130 configured to receive the magnet 78 therein. In one particular embodiment, the magnet 78 is shaped as a generally rectangular member; however, any shapes of a magnet 78 are entirely possible. The magnet 78 is disposed within the opening 130 or recess of the insert 76 to dispose the magnet 78 behind the sloped wall 128. This allows the magnet to attach or grip to the metallic tip of the blade when the grip body is attached to the attachment mechanism and the tip of the blade is sheathed within the attachment mechanism 38. More particularly, the first side surface 132 of the magnet is positioned closely against the inner sidewall or sloped wall 128 of the opening such that the magnetic force exhibited by the magnet 78 can connect to the metallic blade and substantially attach the blade to the upwardly tapered sloped wall 128.

With continued reference to FIG. 3A, the attachment mechanism 38, as previously described, may be connected to the firearm in a number of different ways. When the screw 44 is utilized to connect the attachment mechanism 38 to a rail 24 of the firearm 12, a nut 134 has complementary threads to the screw 44. The screw 44 may be disposed in a transverse channel 136 that perpendicularly intersects channel 42 and extends entirely through the second side portion 48. However, as described herein, other releasable attachment mechanisms are entirely possible and a different configuration other than the screw 44 and nut 134 may be utilized.

Figure 3B:
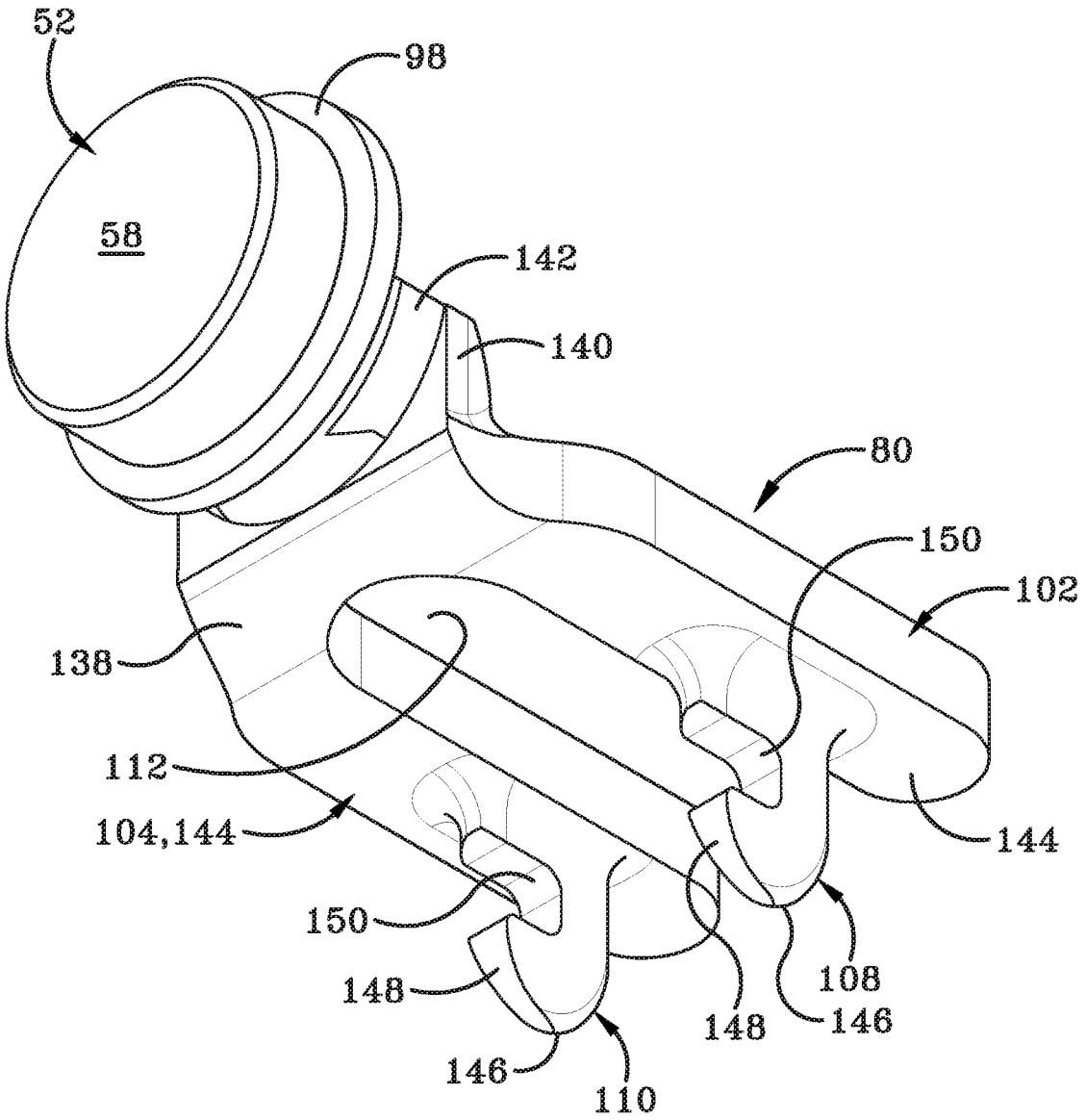
FIG. 3B is a bottom perspective view of a U-shaped member used as a lock within the attachment mechanism.

FIG. 3B depicts a bottom perspective view of the U-shaped member 80 and its connection with button 52. U-shaped member 80 includes a rear cross member 138 extending between the rear ends of the first leg 102 and the second leg 104. Crossmember 138 bounds a rear end of the gap 112. A vertical wall 140 extends upward from the crossmember 138. A rear end of the button 52 is connected to the vertical wall 140 and extends rearward therefrom. More particularly, a forward end of the collar 98 is connected with a semicircular connection piece 142 to couple the button 52 to the vertical wall 140.

With continued reference to FIG. 3B, the U-shaped member 80 includes a collective lower surface 144. The first prong 108 extends downwardly from the lower surface 144 on first leg 102. The first prong 108 includes a lower end 146. A sloped wall 148 extends upwardly and rearwardly from the lower end 146. Sloped wall 148 is designed to ride along pins in the grip body during the longitudinal translation of the U-shaped member when the button 52 is depressed against the biasing force of spring 82. The first prong 108 defines a cutout 150 that is rearwardly opened and is configured to receive the pins in the grip body therein to lock the grip body to the attachment mechanism 38. The second prong 110 is shaped similar to the first prong 108 and similar reference numerals are utilized to describe similar structural elements of the second prong 110. The second prong 110 is configured to receive a second pin on the grip body opposite the first pin on the grip body to lock the U-shaped member 80 with the grip body 40. As such, each of the respective prongs 108, 110 are offset on opposite sides of the blade when the tip of the blade is sheathed within the attachment mechanism 38.

Figure 4:
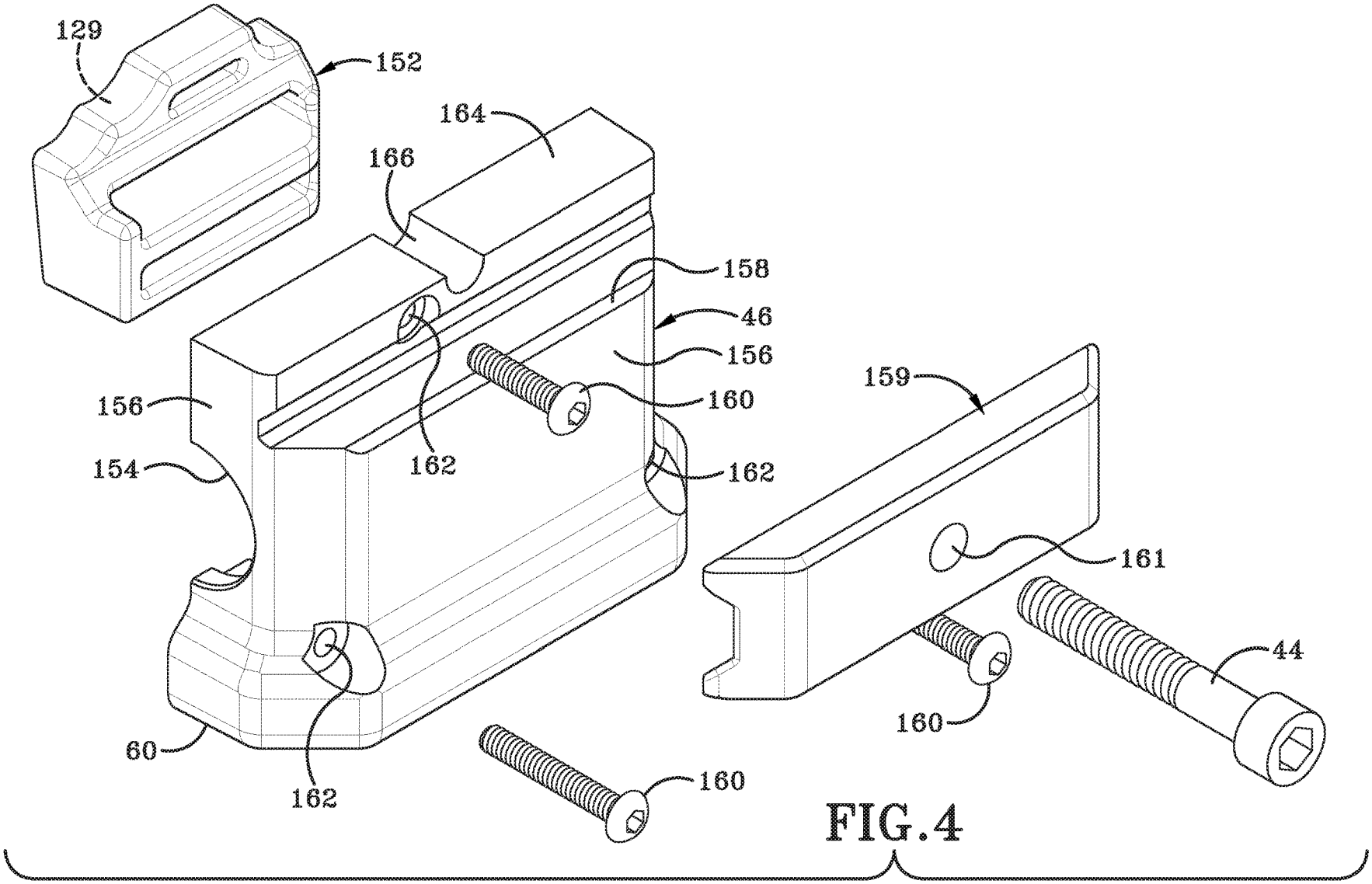
FIG. 4 is an exploded perspective view of additional components for the attachment mechanism.

FIG. 4 depicts an exploded rear perspective view of the first side portion 46. Similar to the second side portion 48, the first side portion 46 houses an insert 152 therein. While not shown in FIG. 4, the insert 152 resides within a recess shaped complementary to insert 152. The recess is generally transversely aligned with recess 84 in second side portion 48. Similarly, insert 152 includes a sloped wall 129 (FIG. 9) shaped in a mirrored relationship as sloped wall 128 that tapers upwardly to retain the upper portion or tip 190 (FIG. 5) of blade 188 (FIG. 5) therein. Similar to the other insert 76, insert 152 may be entirely or at least partially formed from an elastomeric or polymer material such as to create a high friction environment in retaining the tip of the blade when the blade is stored within the attachment mechanism 38 and the grip body 40 is connected thereto in the sheathed position.

With continued reference to the first side portion 46, a semicircular edge 154 may be formed in the rear surface of the first side portion 46. The rear wall 156 of the first side portion 46 aligns and lies flat along the rear vertical plane to be coplanar with rear wall 90 of second side portion 48. An outer sidewall 156 is a substantially flat wall that terminates at an upper edge 158. A plurality of screws 160 extend transversely through corresponding holes 162 in the first side portion 46. The screws 160 are utilized to attach the first side portion 46 to the second side portion 48 via threaded apertures 94 (FIG. 3A). A connector 159 is a longitudinally aligned member that is releasably supported above wedge 158 and is configured to connect with the rail 24 on firearm 12. Screw 44 extends through a central aperture 161 that is transversely aligned with the channel 136 in the second side portion 48 to threadably attach screw 44 with nut 134. More particularly, the upper surface 164 defines a channel 166 that is transversely aligned with channel 136 to receive screw 44 therethrough and an opposing end of the screw is connected with nut 134 on an opposite side of the second side portion 48.

Figure 5:
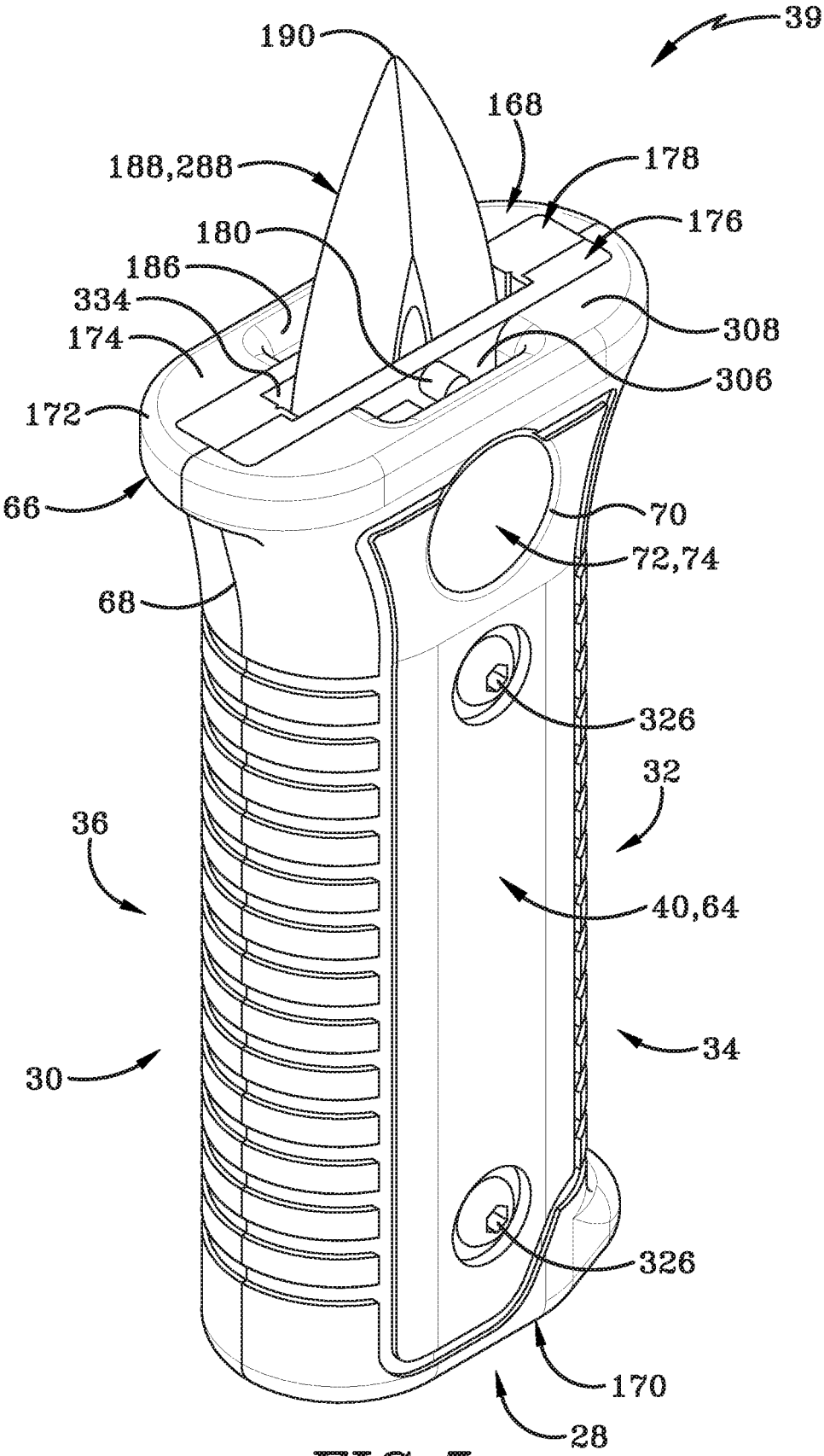
FIG. 5 is a top perspective view of a grip body of the firearm accessory depicting a blade in a sheathed position.

FIG. 5 is a top perspective view of the grip body 40 and blade 188 that collectively define a knife 39 when the grip body 40 is detached from the attachment mechanism or coupler 38. Grip body 40 has an upper end 168 opposite a lower end 170 that defines the bottom 28 of firearm accessory 10. Adjacent the top 168 is a widened longitudinally elongated generally oval edge 172 that is shaped complementary to the lower edge 60 of the attachment mechanism 38. Edge 172 may be slightly rounded and define a convex outer surface at the edge 172. The edge is shaped to contact and directly contact a contour 61 of the lower edge 60. The top 168 of grip body 40 is further defined by an upper flat wall 174. The upper flat wall is substantially planar and flat and when the grip body 40 is connected to the attachment mechanism 38, the upper flat wall 174 is substantially parallel to the longitudinal axis of the firearm 12. The upper flat wall 174 is substantially defined by the first and second side portions 64, 66 of the grip body 40. The side portions 64 and 66 surround first and second frame members. More particularly, a first frame member 176 is associated with the first side portion 64 and a second frame member 178 is associated with a second side portion 66. The upper surface of the first and second frame members 176, 178 is flat and coplanar with the upper wall 174. The first frame member 176 includes a protrusion or pin 180 that extends outwardly from the upper end in a transversely cantilevered manner. The upper end of the protrusion 180 is at the same vertical height or slightly below the top of the first frame member 176. The protrusion 180 resides within a slot 306 defined by the upper flat wall 174 of the first side portion 64 of the grip body 40. The slot 306 is longitudinally aligned and is sized of a sufficient dimension to allow the first prong 108 on the U-shaped member 80 to connect with the protrusion 180. As will be described in greater detail herein, the first prong 108 on the U-shaped member 80 is configured to releasably connect with the protrusion or pin 180 on the first frame member 176 and the second prong 110 is configured to connect with a second protrusion 184 (FIG. 6A) on the second frame member 178. The protrusion or pin 184 is also positioned in a similarly shaped slot 186 (FIG. 6A) formed in the upper flat wall 174 of the second portion 66 of the grip body 40. Similar to the first slot 306, the second slot 186 formed in the second side portion 66 is longitudinally aligned and allows the second prong 110 to fit therein to slidably lock the grip body 40 to the attachment mechanism 38.

FIG. 5 depicts a blade 188 having a tip 190 in a sheathed position. When the blade is in the sheathed position as shown in FIG. 5, the tip 190 of blade 188 is offset from the upper flat wall 174 of the grip body. Stated otherwise, at all times, the tip 190 is exterior the grip body 40. More particularly, and in another particular embodiment, the tip 190 may be offset vertically above the upper end 168 of the grip body 40 when the blade 188 is in both the sheathed position (as shown in FIG. 5) and the extended position (as shown in FIG. 12). While the attachment mechanism or coupler 38 is not shown in FIG. 5, it is to be understood that the configuration of the grip body and blade shown in FIG. 5 is in this position when the grip body 40 is connected to the attachment mechanism 38 as shown in FIG. 2. As will be described in greater detail herein, the blade 188 would rest between the sloped walls 128, 129 on the first insert 76 and the second insert 152. One of the major surfaces of the blade 188 would be magnetically attracted to the magnet 78 that resides within recess 130 on the first insert 76.

Notably, while blade 188 has been described as discussed herein, it should also be appreciated that in lieu of a blade, any elongated member would suffice. For example, instead of blade 188, any elongated member, such as an ice pick or a leg of a bipod, could be carried by the grip body 40. Thus, it is to be understood that the term "elongated member" as used herein not only includes blade 188, but also includes any other device that is elongated having a tip that is operable in two modes, wherein in the first mode the grip body is attached to the firearm and the elongated member is in the sheathed position and in the second mode the grip body is disconnected from the firearm and the elongated member is in the extended position, and that the tip of the elongated member is offset from the upper end 168 of the grip body in both the sheathed and extended position.

Figure 6A:
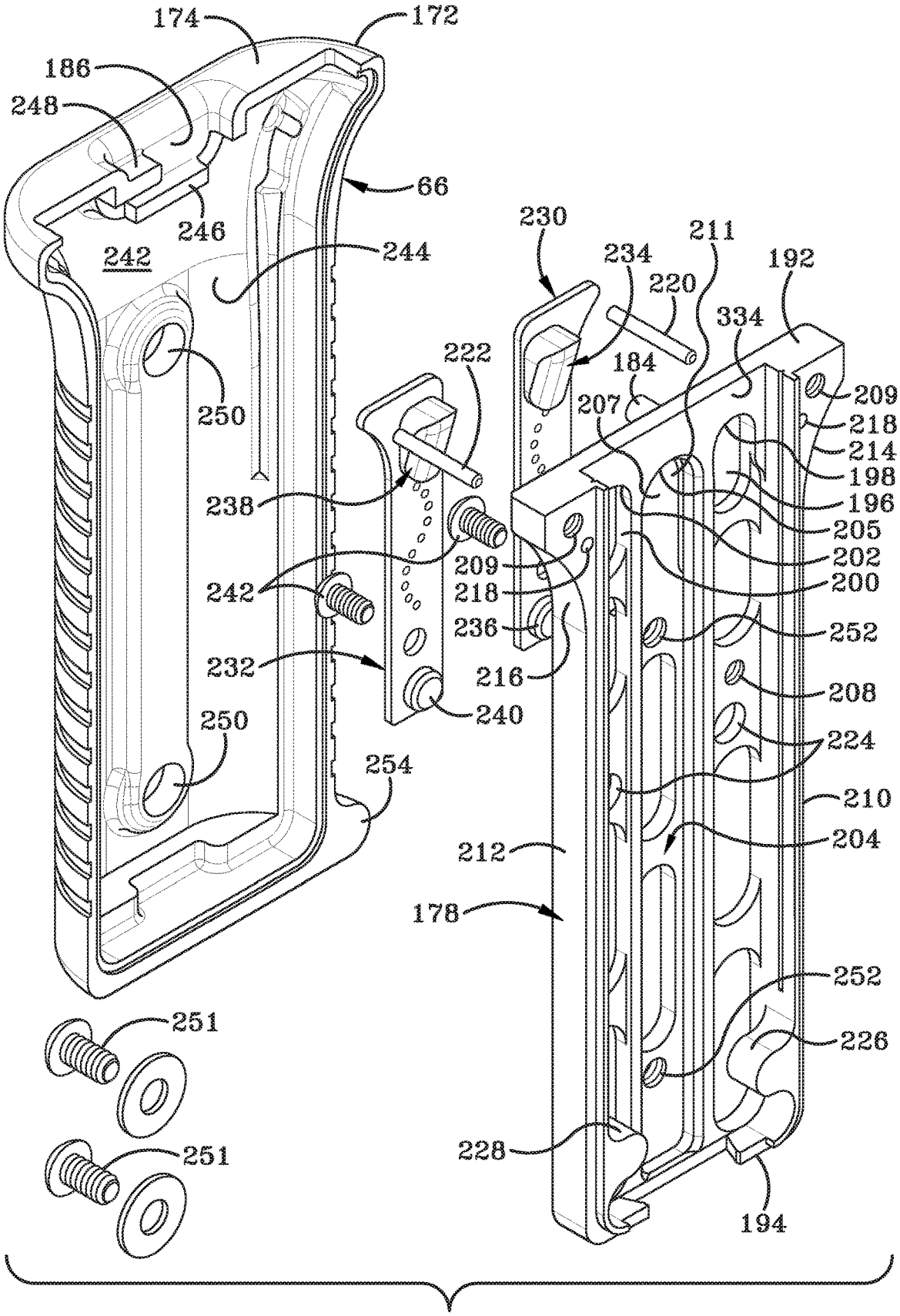
FIG. 6A is an exploded top perspective view of components of the grip body for the firearm accessory.

FIG. 6A depicts an exploded perspective view of the second frame member 178 and the second side portion 66 of the grip body 40. Second frame member 178 includes a top end 192 and a bottom end 194 that are aligned in the vertical direction. Frame 178 has a thickness aligned in the transverse direction measured from a first side to a second side. In one particular embodiment, frame 178 is formed as a uniform unibody monolithic member formed substantially from a rigid material, such as metal or other hardened polymers. Frame 178 defines a plurality of transversely aligned apertures extending entirely through the frame member 178 from its first side to its second side. A first pair of apertures are positioned adjacent the upper end 192 of the second frame member 178. More particularly, a first through aperture 196 is defined and bound by an oval edge 198 and extends entirely through the frame member 178. A second aperture 200 is defined and bound by an oval edge 202 and extends entirely through the frame member 178 from its first side to its second side. Inasmuch as the second frame member 178 is vertically elongated, the first and second apertures 196, 200 are offset on opposing sides of a central vertical axis of the frame member 178. A vertically elongated channel 204 is defined between the two circular edges 198, 202 and extends substantially along the length of the second frame member 178 from the top end 192 to the bottom end 194. There may be one or more apertures extending transversely through the second frame member 178 that may be in open communication with the channel 204. The upper limit of channel 204 may be bound by a downwardly concave edge 205 to define an upper end 207 of channel 204. Near upper end 207, there may be a tab 211 that can be bend inward into channel 204 to limit travel of the nut 294 (FIG. 7B) that is connected to blade 188. In one particular embodiment, channel 204 may retain a spring 206 (FIG. 7A) that is used to bias the blade 188 from the sheathed position to the extended position. In one specific embodiment, the spring 206 is housed within the lower end of the channel 204 vertically opposite the upper end 207.

The frame may also include a plurality of threaded apertures 208 that extend transversely through the second frame member 78 to allow various components of the grip body 40 to be screwed or otherwise connected to the second frame 178.

With continued reference to the second frame member 178, there may be a first side wall 210 and a second side wall 212 that extend vertically along the length of the frame member 178. The first and second side walls 210, 212 may flare outwardly adjacent the top 192 of the second frame member 178 to define a longitudinally widened upper end of the second frame member 178. This configuration defines a first concavely-curved wall section 214 on the first side wall 210 and a second concavely-curved wall section 216 on the second side wall 212. The concave sections 214, 216 on the respective side walls 210, 212 cause the top 192 of the second frame member 178 to have an enlarged longitudinally-aligned width adjacent the top 192 of the second frame member relative to the bottom 194. The widened or enlarged upper end at the top 192 of the second frame member defines additional threaded apertures 209 as well as smooth bore apertures 218. The smooth bore apertures 218 extend fully transversely through the second frame member 178. The smooth bore apertures 218 receive pins therethrough. More particularly, a first pin 220 extends through the smooth bore aperture 218 adjacent the first concave section 214 and a second pin 222 extends through the smooth bore aperture 218 adjacent the second concave section 216. As will be described in greater detail below, the first and second pins 220, 222 are in operative communication with first and second liner locks that are operative to unlock and lock the blade 188 from its extended position.

With continued reference to second frame member 178, smooth bore apertures 224 may extend transversely through the second frame member 178 and receive a complementary-sized protrusion on the liner locks 230, 232. The smooth bore apertures 224 are positioned vertically below aperture 196, aperture 200, and apertures 218.

Adjacent the bottom 194 of the second frame member 178 are internally projecting extensions from the first side wall and the second wall. More particularly, a first extension 226 extends rearward from the first sidewall 210 and a second extension 228 extends forward from the second side wall 212. The first and second extensions 226, 228 are in operative communication and define a bottom limit of travel of the blade 188 when it is collapsing from the extended position into the sheathed position.

With continued reference to FIG. 6A, a first liner lock 230 and a second liner lock 232 are operatively connected to the second frame member 178. Each liner lock 230, 232 has opposing first and second major surfaces and a minor surface defined by the transversely-aligned thickness of each respective liner lock. The first major surface is positioned to face outward while the second major surface is configured to face inward towards the second frame member 178. Each liner lock has a plurality of components that extend outwardly in a cantilevered manner from the second major surface to connect with the second frame member 178. More particularly, the first liner lock 230 includes a tapered protrusion 234 that is associated with the upper end of the liner lock 230 and a cylindrical protrusion 236 that is associated with the lower end of liner lock 230. Similarly, the second liner lock 232 includes a tapered protrusion 238 that extends outwardly in a transversely cantilevered manner from adjacent the upper end of the second major surface of the second liner lock 232 and a cylindrical protrusion 240 that projects outwardly in a cantilevered manner from the second major surface of the second liner lock 232. When the liner locks are assembled and operatively connected to the second frame member 178, the cylindrical protrusion 236 on the first liner lock 230 fits within the smooth aperture 224 on the second frame member 178 and the tapered protrusion 234 on the first liner lock 230 fits through the aperture 196 in the second frame member 178. Similarly, the cylindrical protrusion 240 on the second liner lock 232 fits within another smooth aperture 224 in the second frame member 178 and the tapered protrusion 238 on the second liner lock 232 fits within the aperture 200 in the second frame member 178. The liner locks 230, 232 may further include enlarged apertures configured to receive screws 242 therethrough that threadably attach with threaded apertures 208 to secure the liner locks 230, 232 to the second frame member 178.

With continued reference to FIG. 6A, the second side portion 66 includes an inner surface 242 that defines a recess that is configured to retain the second frame member 178 and the components connected thereto, such as, the first and second liner locks 230, 232 and pins 220, 222. To accommodate the widened upper end of the top 192 of the second frame member 178, the recess 244 defined by the inner surface 242 is widened near its upper end. The slot 186 formed in the upper wall 174 of the second side portion 66 is in open communication with the recess 244. The longitudinally aligned slot 186 receives protrusion 184 therein. The slot 186 may be bound by a longitudinally extending lower wall 246 that is positioned below protrusion 184 on the second frame member 178.

Additionally, an intermediate wall 248 may define a step down and limit a longitudinal direction of travel of the second prong 110 in the rearward direction and also prevent the prong 110 from entering the slot 186 if the grip body 40 is installed backwards. Towards this end, the wall 248 acts as a stop block to make one embodiment of the accessory 10 a unidirectional attachment (i.e., able to be attached in only a single direction). Stated otherwise, the intermediate wall 248 that protrudes and extends into the slot 186 has the purpose of ensuring that the grip body 40 can only be inserted into the attachment mechanism 38 in a single direction. Stated otherwise, the intermediate wall 248 is used as a stop or a block to prevent the grip body 40 from being inserted into the attachment mechanism backwards. Namely, if trying to insert the grip body into the attachment mechanism with the intermediate wall 248 being positioned forwardly, relative to the trigger, from the forward lower protrusion 254, then the intermediate wall 248 will contact one of the lower prongs 108, 110 on the U-shaped member 80 and prevent the prongs from engaging the pin 184.

With continued reference to FIG. 6A, second side portion 66 may include through apertures 250 that extend transversely fully through the second side portion to allow screws to threadably connect the second side portion 66 to connect with threaded apertures 252 on the second frame member 178. Adjacent the bottom 170 of the grip body, there may be a forward-extending protrusion 254 that extends forwardly from the exterior surface of the second side portion 66 that acts as a finger stop when a user is gripping the exterior surface of the grip body 40.

With continued reference to FIG. 6A, screws 251 are inserted through apertures 250 in the second side portion 66 of grip body 40 to connect the second side portion 66 of the grip body 40 to the second frame member 178 via threaded apertures 252.

Figure 6B:
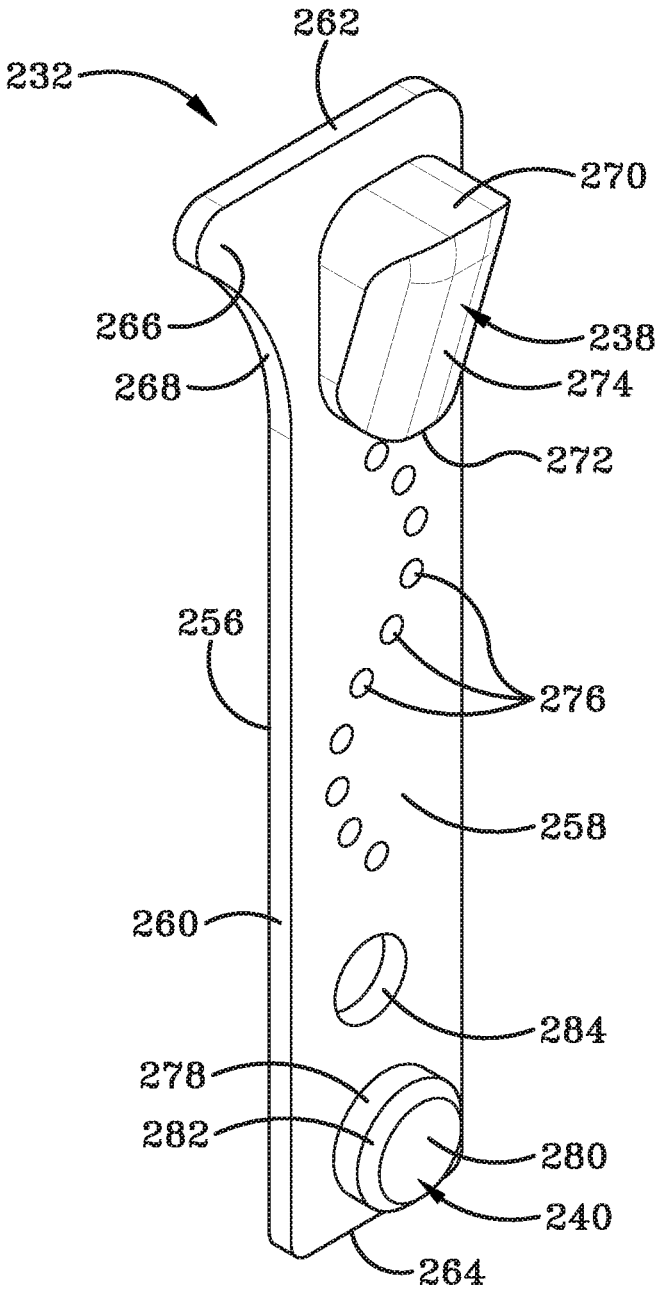
FIG. 6B is a perspective view of one liner lock.

FIG. 6B is a perspective view of the second liner lock 232. As discussed previously, the second liner lock 232 includes a first major surface 256 and a second major surface 258. A thickness of the liner lock is defined between the first major surface 256 and the second major surface 258. The thickness of the liner lock defines a sidewall or minor thickness 260 extending entirely around the second liner lock 232. Liner lock 232 includes an upper end 262 and a lower end 264. The upper end 262 of liner lock 232 is longitudinally widened relative to the lower end 264. The widened upper end 262 defines a protruding portion 266 that defines a concave section 268 of the minor surface 260. The protruding portion 266 causes the pin 222 to contact the second major surface 258 adjacent the upper end 262 at the protruding portion 266.

With continued reference to liner lock 232, the tapered protrusion 238 includes a top wall 270 that has a greater transverse dimension than a lower wall 272 and defines a downwardly-tapering sloped surface 274 that tapers downwardly from the top wall 270 to the lower wall 272. In one particular embodiment, the exterior surface of the sloped wall 274 may be convexly-curved relative to a vertical center line of the liner lock 232. Below the lower wall 272 may be a plurality of weakening apertures 276 that are configured to purposefully weaken the rigidity of the liner lock 232. The purpose of the apertures 276 weakening the rigidity of the liner lock 232 is to allow the liner lock to flex more easily when it is moving between locked and unlocked positions relative to the blade. Additionally, the weakening apertures 276 may be formed in a geometric configuration generally resembling an S-shaped curve. However, other unique geometric configurations of the weakening apertures 276 that extend fully from the first major surface 256 to the second major surface 258 may have other geometric configurations. For example, the weakening apertures 276 may be formed in an array or may be formed in a straight line. However, according to one specific embodiment, the S-shaped curve of the apertures has been found to provide good flexibility for the liner lock 232 to flexibly bend outward as the blade is moving from the sheathed position to the extended position, and provide good flexibility of the liner lock when the button 272 is being depressed to press the pin 222 against the protruding portion 266 to allow the liner lock to flex outward so the blade may be collapsed from the extended position into the sheathed position.

With continued reference to the liner lock 232, the cylindrical protrusion 240 near the lower end 264 of the liner lock 232 extends outwardly in a cantilevered manner from the second major surface 258. Cylindrical protrusion 240 may include a cylindrical side wall 278 and a terminal end wall 280 that is offset generally parallel to the second major surface 258. In one particular embodiment, a chamfered wall 282 may connect the terminal end wall 280 to the cylindrical side wall 278. Another aperture 284 may extend fully through the liner lock from the first major surface 256 to the second major surface 258 and may be positioned vertically above the cylindrical protrusion 240 and vertically below the weakening apertures 276. Aperture 284, as referenced herein, is used to receive screws 242 therethrough that connect with threaded apertures 208 in the second frame member 178. Similarly, as referenced herein, cylindrical protrusion 240 is used to connect the liner lock to the second frame member by inserting the cylindrical protrusion 240 through the aperture 224 in the second frame member 178. When the liner lock 232 lies flush against the exterior side surface of the second frame member 178, the second major surface 258 lies substantially flush with the outer surface of the second frame member and the tapered protrusion 238 fits within aperture 200 of the liner lock. Accordingly, the liner lock 232 is disposed between the exterior surface of the second frame member 178 and the inner surface 244 of the second side portion 66 of the grip body 40. Notably, the first liner lock 230 has similar structures represented by similar reference numerals but are mirrored about a center vertical axis of the grip body 40.

Figure 7A:
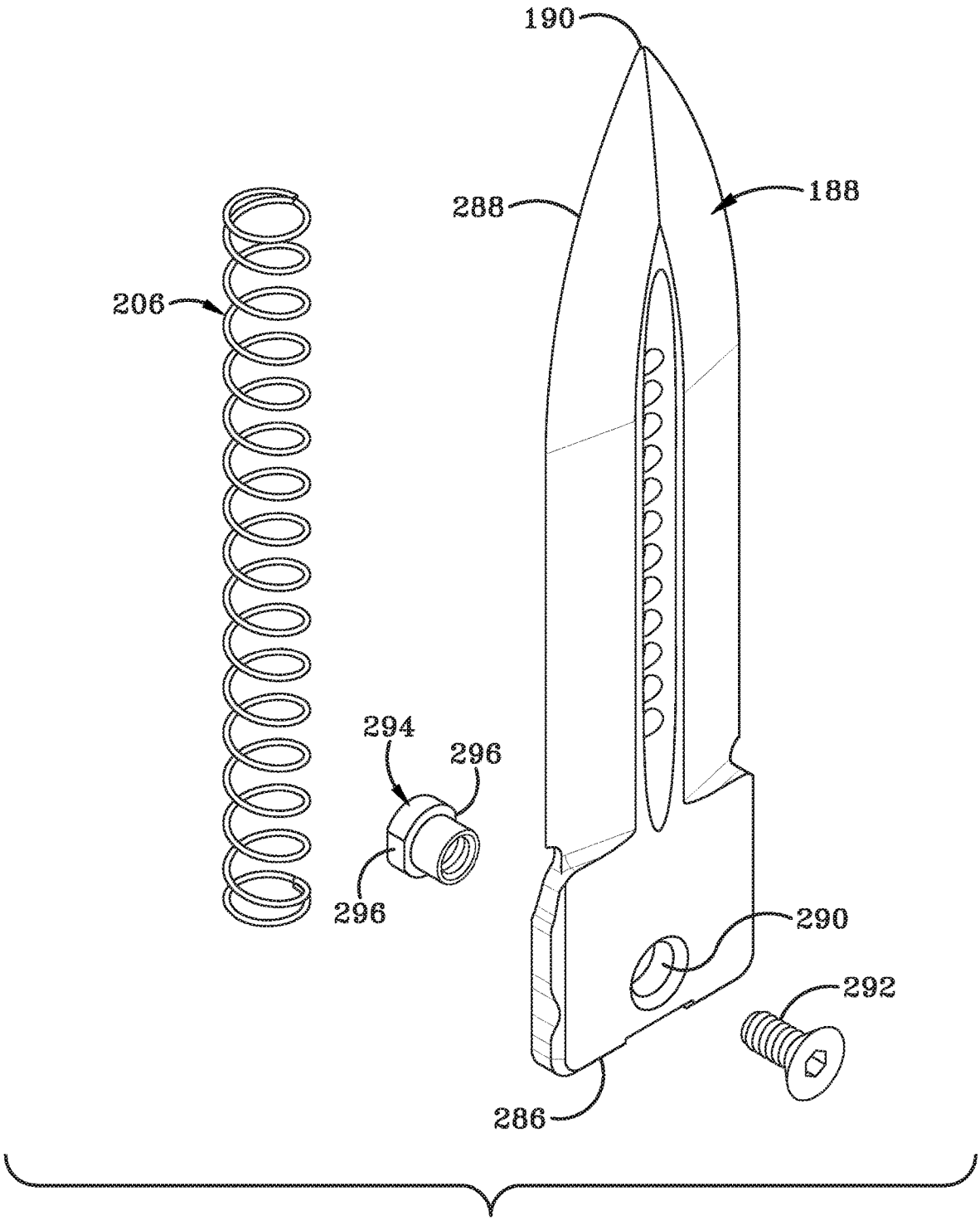
FIG. 7A is an exploded first side perspective view of a blade and a spring.
Figure 7B:
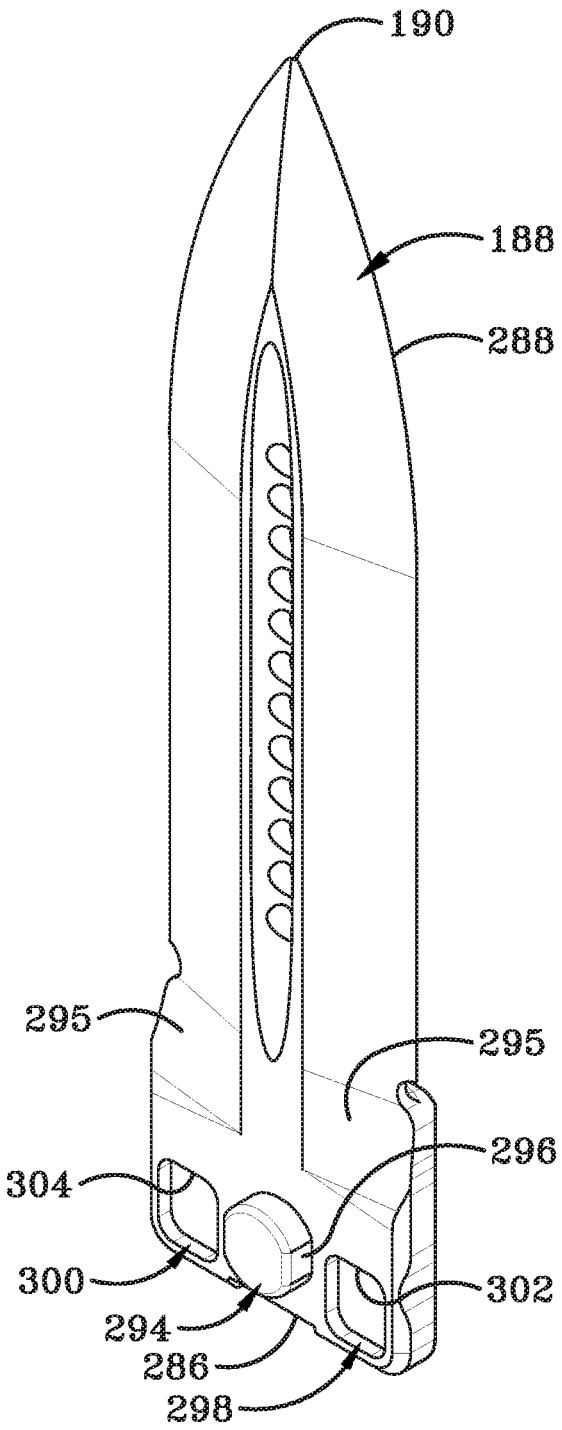
FIG. 7B is a second side perspective view of the blade.

FIG. 7A and FIG. 7B depict the blade 188 having the tip 190 that defines a first end of the blade and an opposite second end 286 defining a base or second end of the blade 188. Blade 188 may have a sharpened edge 288 extending from the tip 190 towards the second end 286. Adjacent the second end 286, the blade 188 defines a through aperture 290 that extends entirely through the blade from its first side surface to its second side surface. As shown in FIG. 7A, aperture 290 is configured to receive a screw 292 therethrough. Screw 292 connects with a nut 294 having a flattened head that is sized to be slidably received within channel 204 in the second frame member 178. The flat wall 296 on the nut 294 maintains a substantially uniform position relative to the side walls of the channel 204 as the nut translates along a vertical axis when the blade 188 is being urged by spring 206. Alternatively, screw 292 may be removed and the nut 294 may be frictionally interference fit in aperture 290 or be simply welded to the bottom of the blade.

As depicted in FIG. 7B, the blade 188 additionally defines a first recess or depression 298 and a second recess or depression 300. The recesses or depressions 298, 300 do not extend entirely through the blade 188. Rather, the recesses are squared depressions with rounded corners that are configured and sized to receive the tapered protrusions 234, 238 on first and second liner locks 230, 232, respectively, when the blade is in the extended position. When the blade is in the extended position, the liner locks allow the tapered protrusions to lock the blade in the extended position by engaging the top wall 270 of each respective tapered protrusion 234, 238 against the top edge 302 and 304 of the respective recess 298, 300. When the liner locks are flexed outward, the protrusions 234, 238 may disengage from the top edges 302, 304 of the respective recesses 298, 300 to allow the blade to be vertically moved downward to compress the spring 206 and move the blade towards the sheathed position.

With continued reference to FIG. 7B, the blade 188 has a secondary bevel/transition 295 that aids in reducing friction against the liner locks 230,232 during blade deployment (i.e., moving to the extended position) or retraction (i.e., towards the sheathed position).

FIG. 8 depicts an exploded perspective view of the first side portion 64 of the grip body 40 and the first frame member 176 along with the button 72 that is intermediate the first side portion 64 and the first frame member 176.

Similar to the second side portion, the first side portion 64 includes a slot 306 formed in the upper wall 308. An intermediate wall 310 is disposed within the slot that is operable as a block or a stop similar to intermediate wall 248 to ensure that the grip body can be installed in only a single forward-facing direction. First side portion 64 of grip body 40 additionally defines a circular aperture 312 configured to receive the surface 74 of button 72. Button 72 includes an inner wall 314 that flares outwardly to a first end 316 and a second end 318. The respective ends 316, 318 of the flared wall 314 are configured to engage the first pin 220 and the second 222 that extends through smooth bore apertures 320, 322, respectively, formed in the first frame member 176. The flared wall 314 allows the button 72 to be depressed to move the pins 220, 222 to bias or flex the first and second liner locks 230, 232 outwardly away from the second frame member 178. Button 72 includes a rear protrusion 317 that acts as a fulcrum or pivot point when the button 72 is depressed.

First side portion 64 additionally defines apertures 324 which receive screws 326 therethrough that connect the first side portion 64 to the first side frame member 176 via threaded apertures 328 formed in frame member 176. Additionally, screws 330 extend through upper apertures 332 to connect the first side frame member 176 with the second side frame member 178 via threaded apertures 209 (FIG. 6A) formed in the second frame member 178 near the upper longitudinally widened end of second frame member 178. When the second frame member 178 is connected to the first frame member 176 the blade 188 is positioned between the first and second frame members and a portion of the blade extends between the upper ends of the frame members 176, 178 which collectively form a slotted opening 334.

Similar to the second frame member 178, the first frame member 176 includes first and second side walls 336, 338 that define an upper concave section 340, 342, respectively. As such, the first frame member 176 has a general shape similar to that of the second frame member 178 in which the upper end of the first frame member 176 has a larger dimension than the lower end portion of the first frame member. In one particular embodiment, the first frame member 176 is formed from the same material that forms the second frame member 178. As such, the first frame member 176 is also a unibody uniform monolithic member. Frame member 176 may additionally include a tab 339 that can be bent inwardly towards the blade 188 to help limit the travel and movement of the blade 188 in the extended position.

Figure 9:
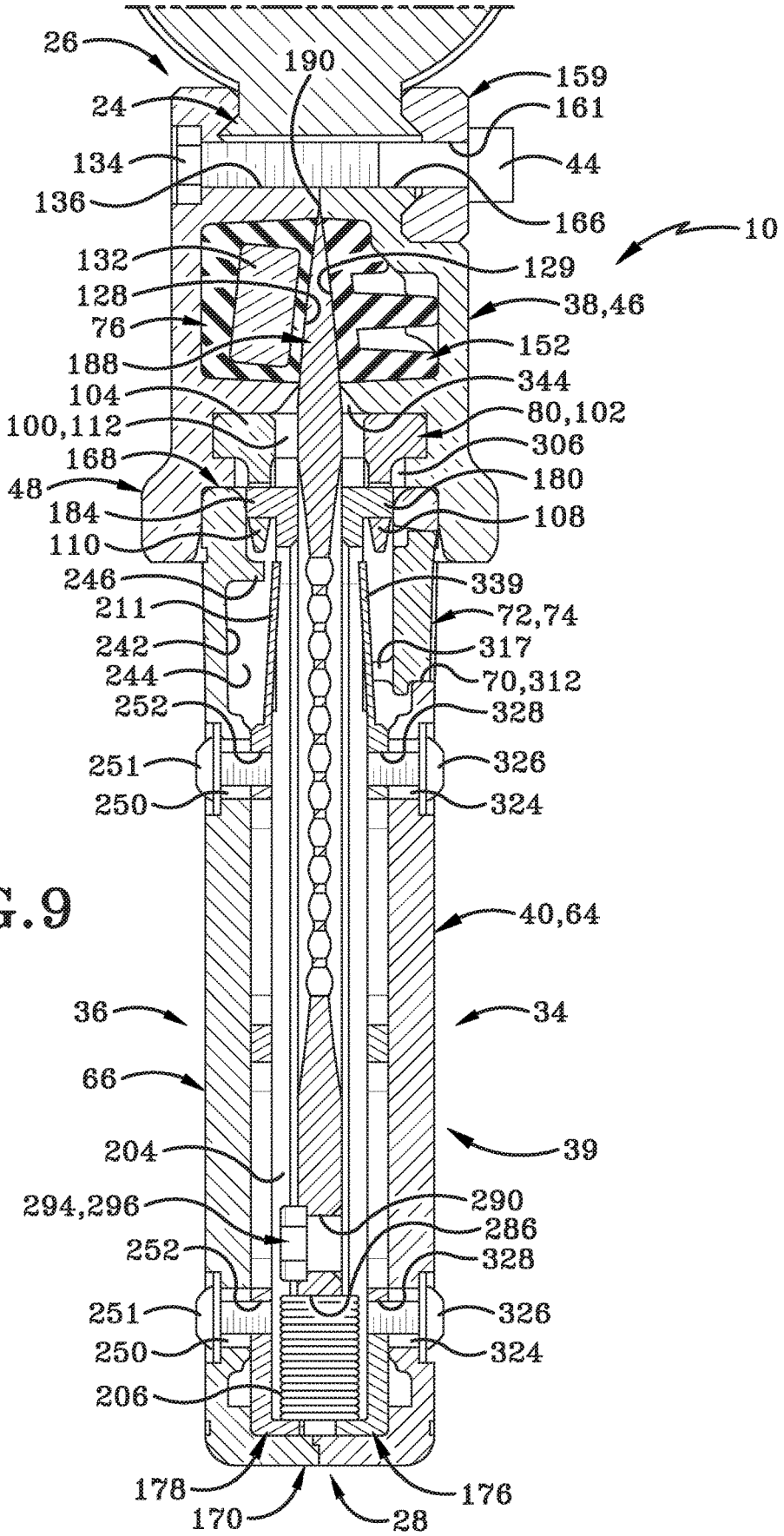
FIG. 9 is a vertical transverse cross section view of the firearm accessory mounted to a firearm with a blade in a sheathed position.

FIG. 9 depicts that the screw 44 is used to compressively tighten the dovetail Picatinny rail relationship formed between the rail 24 on the firearm 12 and the channel 42 defined in the second side portion 48 of the attachment mechanism 38. When the attachment mechanism 38 is connected to the rail 24 or another portion of the firearm 12, the first and second inserts 76, 152 define a space between their respective sloped walls 128 to receive the tip 190 of the blade 188 therein. The sloped wall of the insert 152 is shown as sloped wall 129 in FIG. 9. The space between sloped wall 128 and sloped wall 129 is upwardly tapered towards the parting line 50 and frictionally engages the blade between the first and second inserts 76, 152. The magnet is clearly seen as being positioned within the recess 130 of the second insert 76. More particularly, surface 132 on magnet 78 closely abuts the first side 124 of insert 76.

As shown in FIG. 9, when the grip body 40 and blade 188 are in the sheathed position (i.e, the first mode connected to the coupler defining a foregrip for a firearm 12), as depicted in FIG. 9, the tip 190 of the blade 188 is disposed between the two inserts 76, 152. Additionally, the tip 190 of the blade is positioned vertically above the magnet 78. Additionally in the sheathed position, the tip 190 of the blade 188 is positioned vertically above the upper end 160 of the grip body 40. Thus, it can be said that with respect to the sheathed position, the tip 190 of the blade 188 is exterior to the grip body 40. Similarly, the tip 190 of the blade 188 is sheathed within the attachment mechanism that connects directly to the knife. This embodiment differs from previous teachings which may have sheathed the tip of the knife entirely within the grip body 40.

With continued reference to FIG. 9, below the insert 76 and insert 152 is an upwardly tapered sloped slot 344 defined by upwardly tapering side walls. The upwardly tapering side walls defining the slope slot allow for the blade to easily find the space defined between sloped wall 128 and sloped wall 129 when the blade is being inserted into the attachment mechanism to be placed into the sheathed position. Slope slot 344 is positioned vertically above slot 100 that retains the U-shaped member 80 therebelow.

With continued reference to FIG. 9, the U-shaped member is positioned on each side of the blade 188 when the blade 188 is in the sheathed position. More particularly, the first prong 108 is offset and positioned to the right of (as shown in FIG. 9) the first side surface of blade 188. The second prong 110 is offset to the left (as shown in FIG. 9) of the second side surface of the blade 188. A slight gap between the prongs and the surfaces of the blade is established to ensure that the U-shaped member does not contact the blade. Each of the prongs extends downwardly to contact the respective pins 180 and 184 on the first and second frame members 176, 178, respectively. As shown in FIG. 9, the prongs 108, 110 that engage the pins 180, 184 lock the grip body 40 to the attachment mechanism 38. The U-shaped member 80 is positioned below the tip 190 of the grip body when the blade 188 is in the sheathed position. More particularly, the first prong 108 and the second prong 110 extend downwardly from a portion of the attachment mechanism 38 and would be vertically below the tip 190 of the blade 188 when the grip body 40 is in the sheathed position; however, when the blade is extracted from the attachment mechanism 38, the tip 190 of the blade 188 may be vertically below the first prong 108 and the second prong 110.

When the blade and grip body are in the sheathed position, as shown in FIG. 9, the liner locks do not engage the depressions 300, 302 formed at the lower end of the blade. Rather, in the sheathed position, the liner locks, and more particularly, the tapered protrusions 234, 238 are pushed out of the way and do not engage the blade in a manner that would preclude its movement. Rather, in the sheathed position, the U-shaped member locks the grip body 40 to the attachment mechanism 38, and the blade is retained between the two inserts 76, 152. Liner locks simply rest in a flexed position outwardly and do not lock the blade. The liner lock may have portions that may simply contact the surface of the blade incidentally but would otherwise not preclude movement or permit movement of the blade in the sheathed position but for the blade being limited by its connection and placement between sloped walls 128, 129.

The nut 294 having flat wall 296 that rides within the channel of the frame member is shown in FIG. 9 without having the screw 292 being inserted therethrough. Thus, it is to be understood that the screw 292 may be removed and the nut 294 may simply be an insert that is frictionally interference fit with aperture 290 on the blade. Similarly, rather than a frictional interference fit between insert 294 and the blade 188, it is possible to fixedly attach an external protrusion having a flat wall that would ride within the slot or channel formed in one of the frame members 176, 178.

As shown in FIG. 9, when the grip body and blade are in the sheathed position, the spring 206 may be in a compressed state. The compressed state of the compression coil spring 206 stores potential energy such that when the U-shaped member 80 unlocks from the pins 180, 184 the grip body 40 may be pulled downwardly and away from the attachment mechanism 38 to bias the blade outwardly from the grip body to the extended position.

Figure 10:
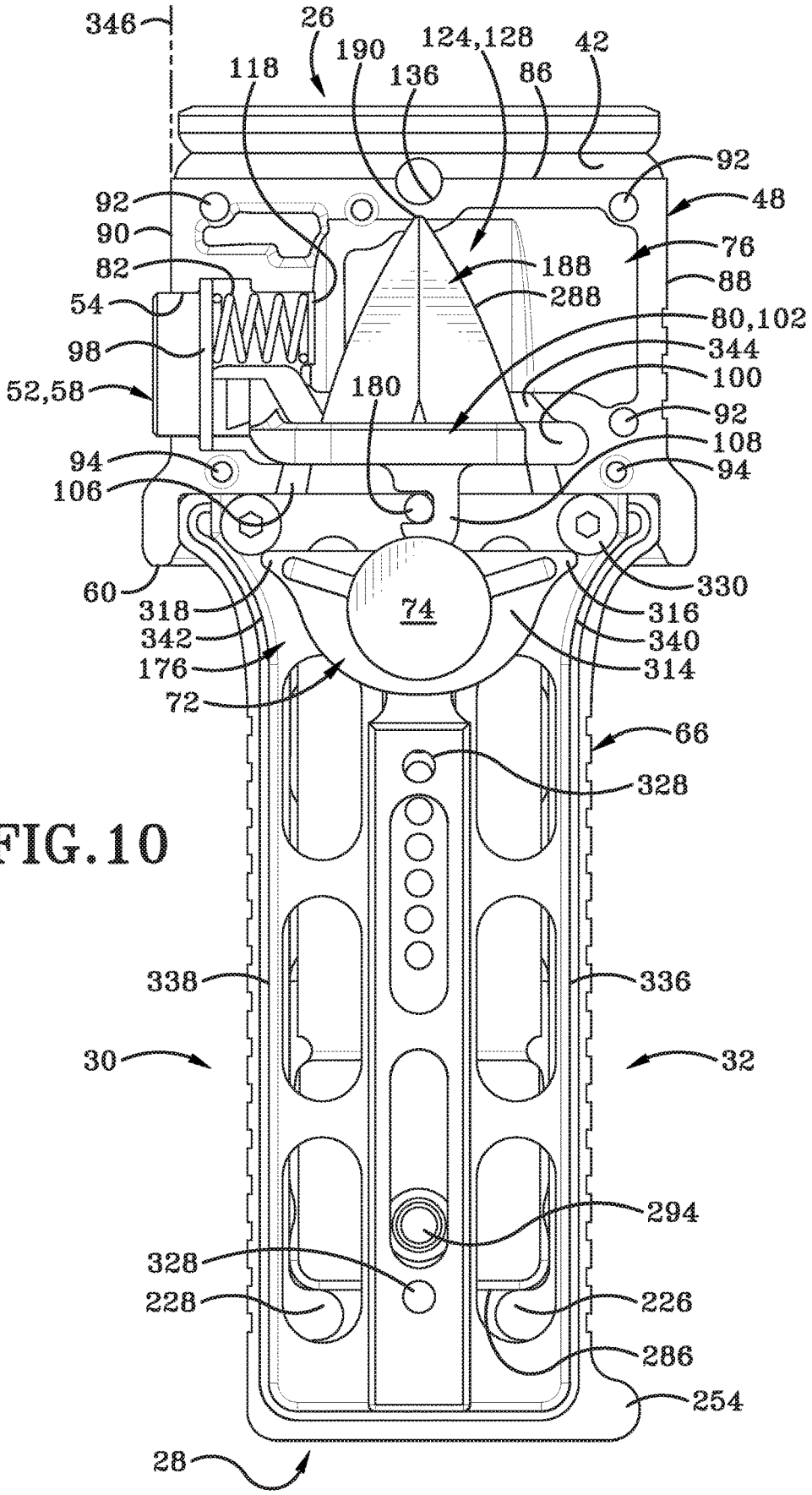
FIG. 10 is a side elevation view of the firearm accessory with the blade in the sheathed position and exterior components of the grip body and the attachment mechanism removed to depict internal components of the firearm accessory.

FIG. 10 depicts side elevation view of the grip body 40 and blade 188 in the sheathed position. In this figure, the view is shown with the first side portion 64 of the grip body and the first side portion 46 of the attachment mechanism having been removed to expose the internal components of other aspects of the grip body and attachment mechanism. In the sheathed position, it is seen that the first prong 108 engages pin 180,184 such that it is received within slot 150 defined by first prong 108. U-shaped member is coupled to the button 52 having its exterior major surface 58 being disposed rearward (to the left in FIG. 10) of the rear vertical wall 90. A vertical plane 346 is defined as extending upwardly such that the rear vertical wall 90 lies along with the vertical plane 346. In the locked and sheathed position, the exterior major surface 58 of button 52 lies rearward from plane 346. By allowing the button 52 to extend rearward from the rear vertical wall 90, this configuration provides a tactile experience for the user to quickly and easily find the button 52 relative to the rear vertical wall 90 so that it may be depressed and moved longitudinally forward against the rearwardly biasing force of spring 82 to move the U-shaped member 80 longitudinally forward within slot 100.

Having thus described the structural configuration of the various components of the firearm accessory 10 which provides the unique advantage of operating in the first mode when the blade is in the sheathed position and in the second mode when the blade is in the extended position while retaining the tip 190 of the blade exterior the grip body in each position, reference will now be made to its operation.

Figure 11A:
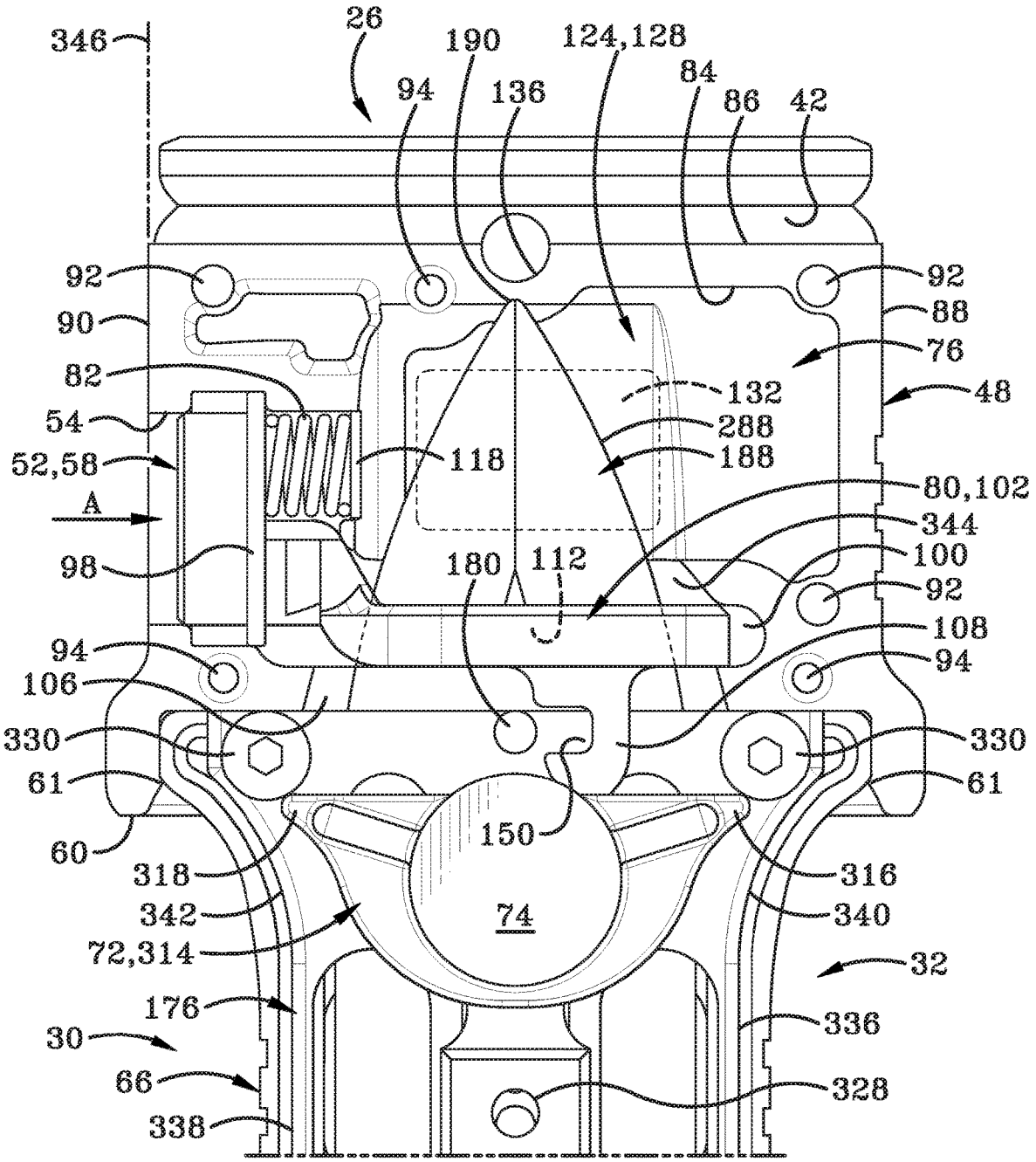
FIG. 11A is an enlarged operational view of the firearm accessory.

In operation, and with reference to FIG. 11A, when the grip body 40 and the blade 188 are in the sheathed position, the U-shaped member may be moved within the slot 100 longitudinally forward to unlock the grip body from the attachment mechanism 38. To do so, a user will depress the button 52 longitudinally forward in the direction as indicated by arrow A. Movement of the button forward in the direction of arrow A compresses spring 82. More particularly, the length of travel required by the movement of button 52 must, at least in one embodiment, pass plane 346 to offset the surface 58 of the button forward from plane 346. This would allow an exemplary advantage of ensuring that if the attachment mechanism were laid on its rear surface and the button 52 were incidentally depressed part way such that the surface 58 aligns or lies along plane 346, the grip body 40 will not be accidentally released from its engagement with the attachment mechanism 38. Stated otherwise, in order to fully unlock the grip body from the attachment mechanism, the button 52 must be fully depressed into the attachment mechanism and be pushed forwardly of vertical plane 346 which is defined by the rear vertical wall. Once the button has been depressed longitudinally forward from the rear vertical plane 346, the spring 82 is compressed and the U-shaped member, mainly, the first and second legs 102, 104 slide longitudinally forward within the slot 100. As the U-shaped member slides longitudinally forward within the slot 100, the prongs 108, 110 also slide forwardly and the slots 150 defined by prongs 108, 110 disengage pins 180, 184 on the first and second frame members 176, 178, respectively. When the button 52 is fully depressed and the U-shaped member is translated longitudinally forward, the grip body will be in an unlocked position relative to the attachment mechanism 38; however, the blade 188 adjacent the tip 190 remains magnetically attached to the magnet 78 housed within the first insert 76.

Figure 11B:
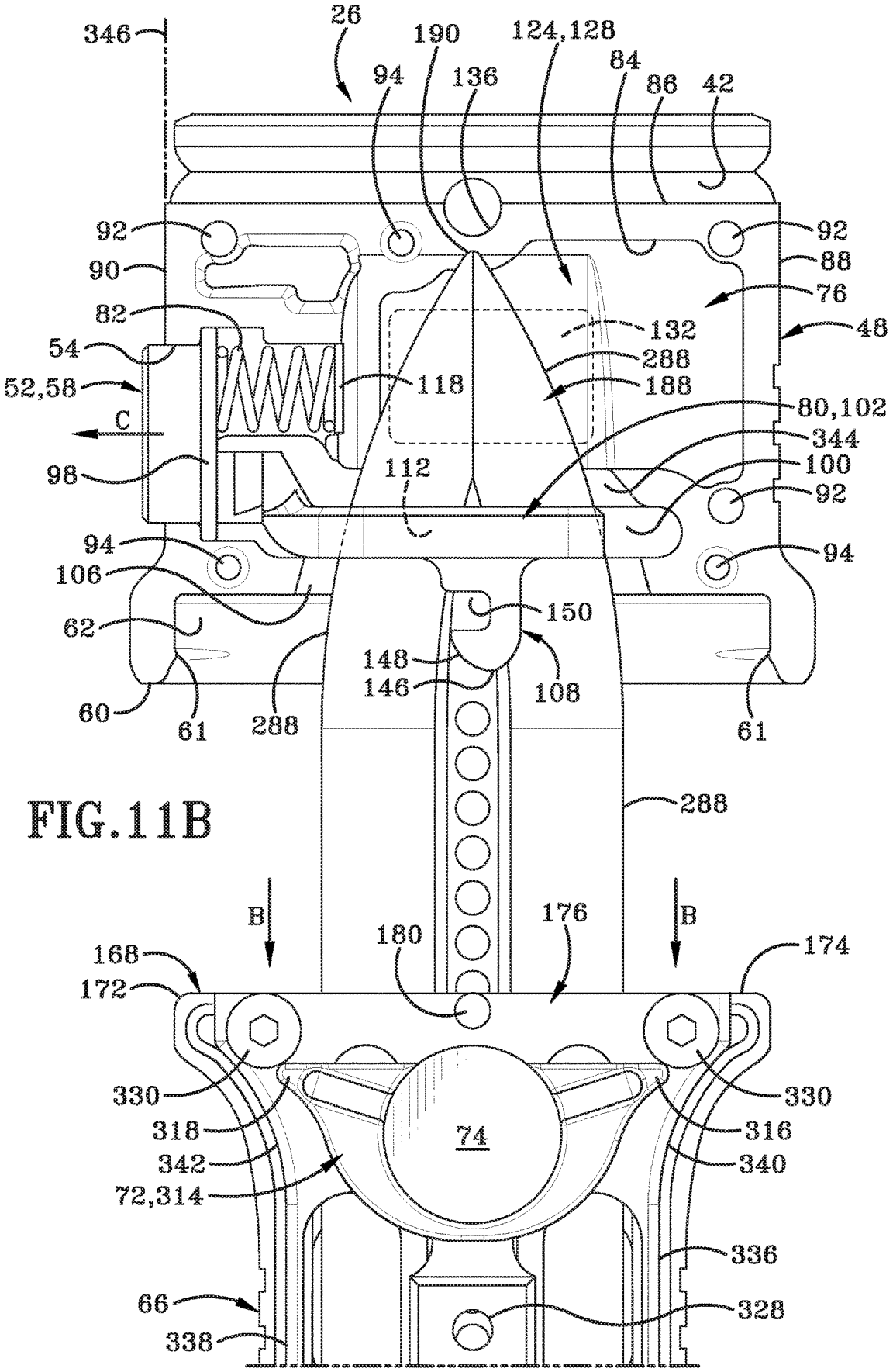
FIG. 11B is an enlarged operational view depicting the firearm accessory being moved from a sheathed position to an extracted position.

In operation and with reference to FIG. 11B, when the button 52 is depressed and the U-shaped member 80 is translated longitudinally forward, a user may grasp the exterior surface of the grip body and pull downwardly as indicated by arrow B. The vertically downward movement of the grip body will begin to extract the blade from its sheathed position to an extended position relative to the top surface 168 of the grip body. While the user is pulling the grip body 40 downwardly in the direction indicated by arrow B, they may release the button 52 which begins to be urged by spring 82 back to its normal resting position as indicated by arrow C. During the extraction or movement from the sheathed position to the extended position, the blade may remain magnetically attached to the magnet 78 within the attachment mechanism. Thus it is to be considered that the extraction of the blade from the sheathed position to the extended position is assisted by two urging forces. Namely, the spring 206 carried by the frame urges the blade outwardly from the grip body and the magnetic attachment of blade 188 to magnet 78 assists the spring 206 by holding it in a position, at least momentarily, to reduce the amount of spring force needed to bias the blade from the sheathed position to the extended position as the user is grasping the grip body and pulling it downwardly in the direction of arrow B.

In operation and with reference to FIG. 12, once the blade has been moved to the fully extended position and the blade 188 disconnected from the magnet 78, a knife 39 is established. The knife 39 is defined by the grip body 40 and the blade 188 being in the extended position. When the knife 39 is defined, the blade 188 is locked by liner locks that engage the depressions near the lower end of the blade 188.

Figure 13:
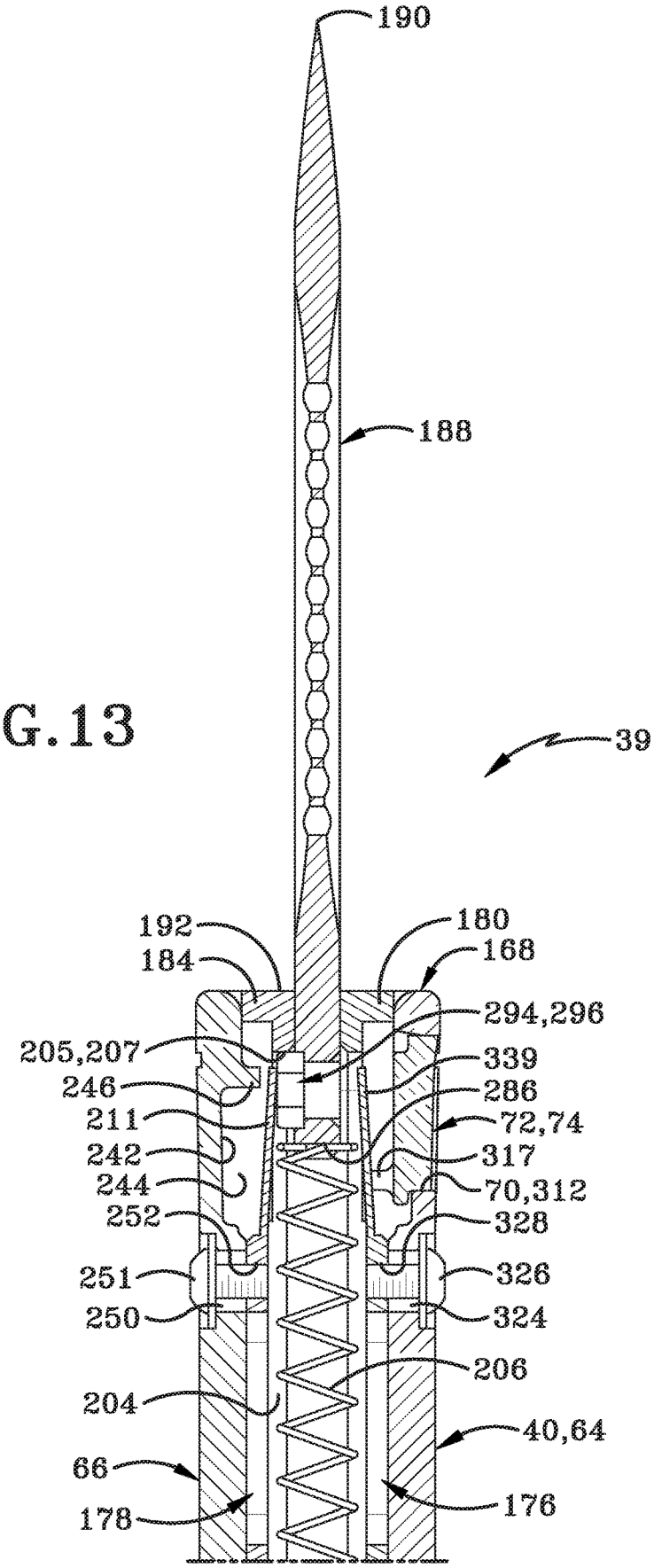
FIG. 13 is a vertical transverse cross section view of the grip body and blade shown in the extended position.

FIG. 13 depicts that the liner locks are oriented in a manner such that the tapered protrusions 238 and 234 fit within the depressions 298, 300. When the grip body and the blade 188 are in the extended position to define the knife 39, the tip 190 of the blade 188 is positioned exterior of the grip body and vertically above the upper end 168 of the grip body 40. Thus, regardless of the mode or position of the blade relative to the grip body, the tip 190 of the blade is always vertical or exterior of the grip body. While other portions of the blade may or may not be within the grip body, it is the tip 190 that remains exterior the grip body in each configuration and at all times during transition from one position to another position. The nut 294 is at the upper end 207 of channel 204 and contacts surface 211 which is positioned above tab 211 and tab 339. The tabs 21, 339 are bent inward towards blade 188 to preclude movement or "wiggle" (i.e., increase stability) of the blade 188.

Figure 14:
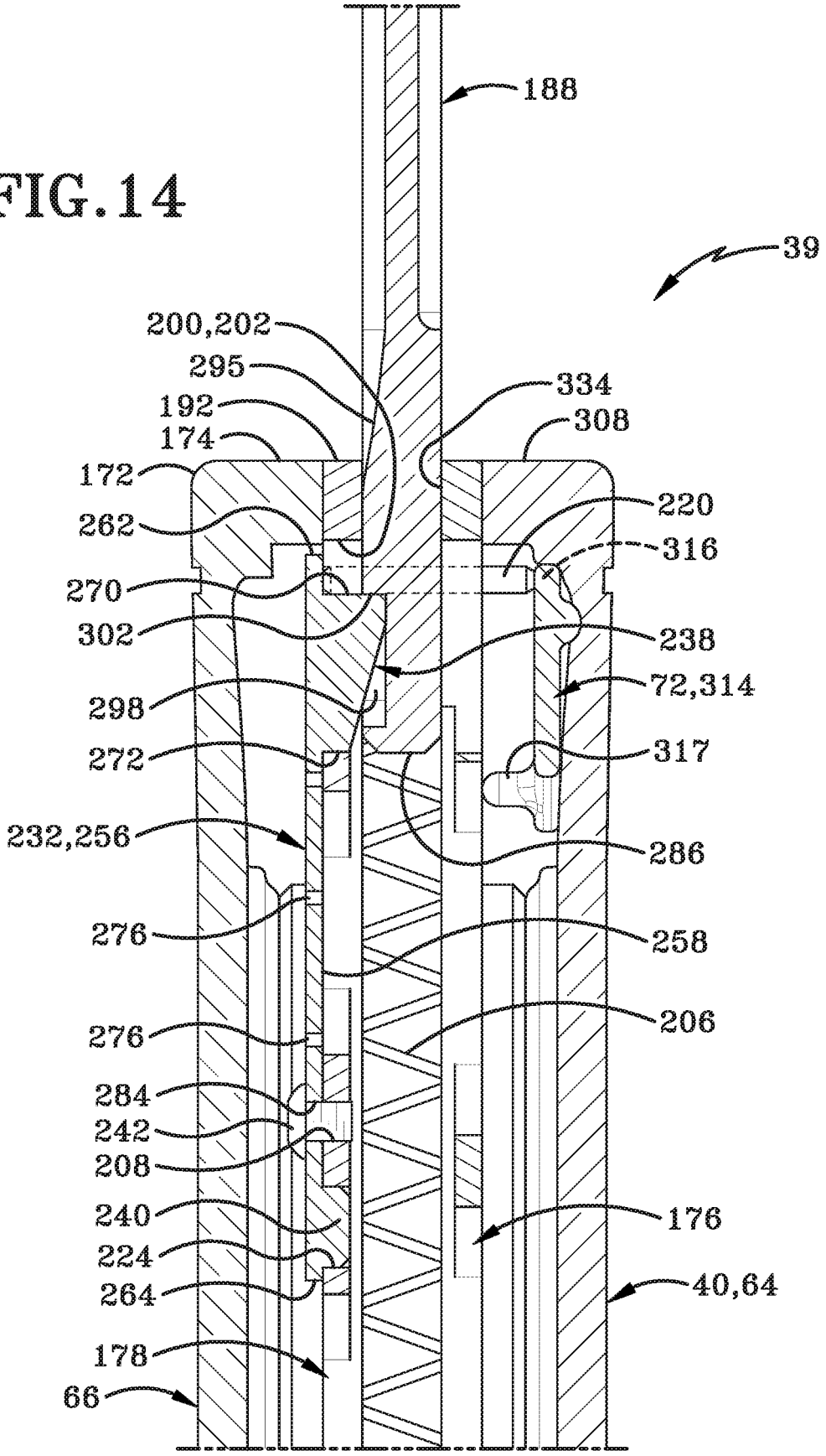
FIG. 14 is an enlarged vertical transverse cross section view of the grip body and blade in the extended position depicting the liner locks that lock the blade relative to the grip body.
Figure 15:
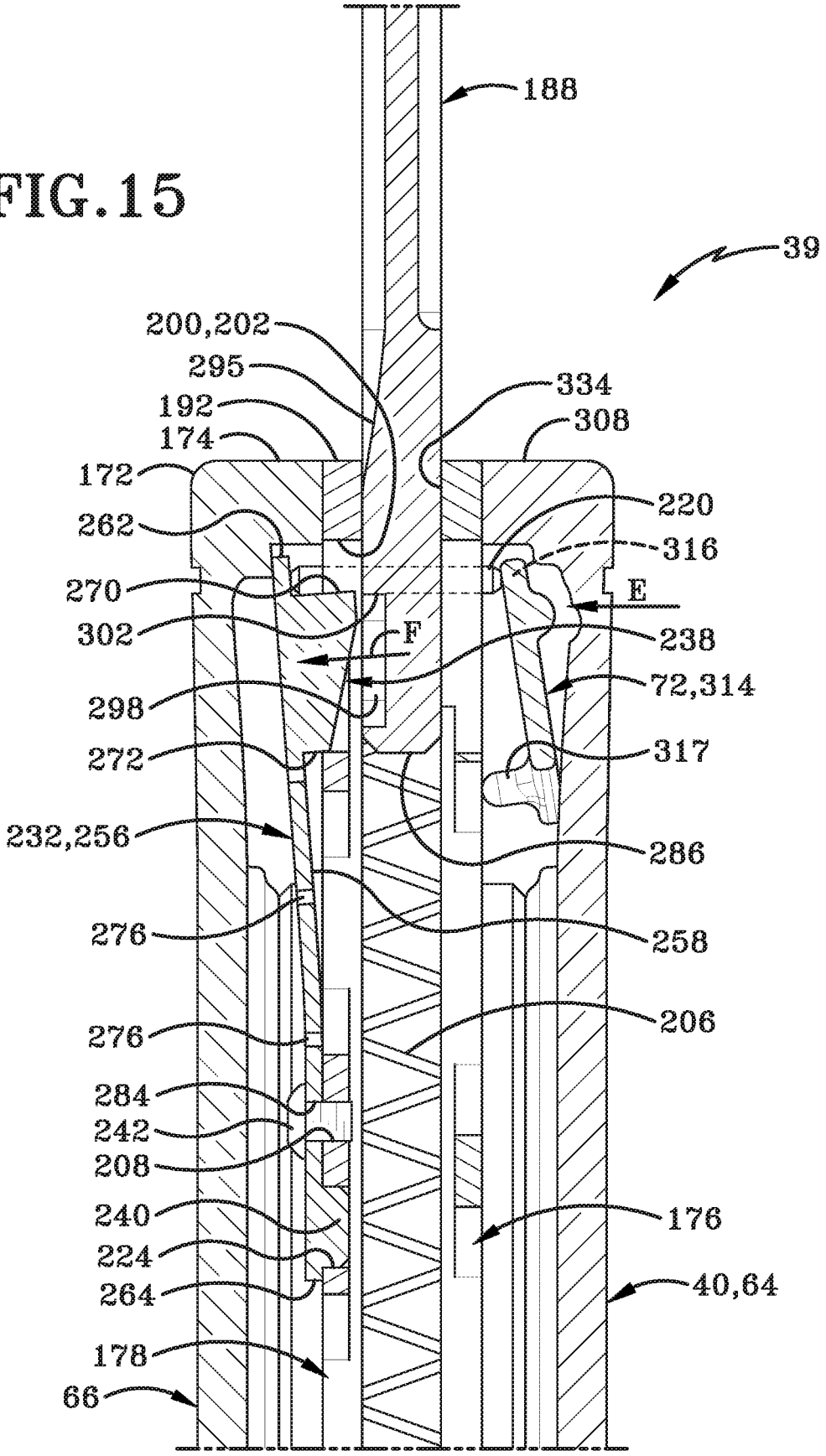
FIG. 15 is an operational vertical transverse cross section view depicting the liner locks being unlocked from the blade.

In operation and with reference to FIG. 14 and FIG. 15, the user may reattach the grip body to the attachment mechanism 38 in order to transition the blade from the extended position to the sheathed position. Initially, the user will move the tip 190 of the blade upwardly towards the attachment mechanism and insert the tip 190 of the blade through the opening 62 defined by the bottom edge 60 of the attachment mechanism 38. The blade moves upwardly between the upwardly tapered slot 344 and into the space between the sloped walls 128 and 129. The upward movement of the tip 190 is indicated at arrow D in FIG. 12. With the blade magnetically attracted to the magnet 78 and frictionally interference fit with the sloped walls 128 and 129, the user may then unlock the blade. More particularly, FIG. 14 depicts the blade as being locked via the liner lock with the top wall 270 engaging the upper edge 304 of the depression 300.

To unlock the liner lock from its locked arrangement, FIG. 15 depicts that the button 72 will be depressed inward in the direction indicated by arrow E. Depression of the button 72 in the transverse direction will cause the flared wall 314 to contact pins 220, 222 at its first and second ends 316, 318, respectively, as the blade pivots about protrusion 317. The pivoting transverse movement of the button in the direction of arrow E will cause the first end 316 to move the first pin 220 and the second end 318 to move the second pin 222. The transverse movement of the pins moving through the smooth bore apertures 218 in frame 178 will contact the upper protruding portion 266 of each respective liner lock 230, 232. The liner lock will be flexed away from the blade as indicated by arrow F. Recall, flexibility of the liner locks is increased by the geometrical configuration of the weakening apertures 276. Accordingly, in one exemplary aspect, the weakening apertures 276 have a functional purpose to allow greater flexibility of the liner lock to flex in the direction of arrow F when the button 72 is depressed in order to disengage the liner lock from the blade 188. When the liner lock is disengaged from the blade, the grip body 40 may be moved upwardly in the direction of arrow D so as to engage grip body with the attachment mechanism. The upward movement in the direction of arrow D cause the lower portion of the blade 188 to retract into the grip body. Specifically, the nut 294 slides in the channel and moves closer to the lower end of the channel 204 as the blade moves within the space defined between the first frame member 176 and the second frame member 178. The lower end 286 of the blade approaches the protrusions 226, 228 and may contact the same when the blade 188 is fully retracted. The retraction of the blade 188 and the upward vertical movement of the grip body 40 will cause the spring 206 to compress and store potential energy that will be harvested or utilized the next time user disconnects the grip body 40 from the attachment mechanism 38 or coupler.

As the grip body 40 is moved upwardly in the vertical direction, the pins 180, 184 contact the first prong 108 and the second prong 110 on the U-shaped member 80, respectively. The convexly curved grounded surfaces 148 on the prongs 108, 110 cause the U-shaped member to translate longitudinally forward against the force of spring 82 in order to compress the same as the user forces the grip body vertically upward. The continued upward vertical force causes the pins 180, 184 to ride along the convexly curved surface 148 of the prongs 108, 110 until the pins 180, 184 move vertically past the convexly curved surface 148 so that they may engage the slot 150 of each respective prong 108, 110. When the pins 180, 184 are within the slot 150, the biasing force of spring 82 pushes the U-shaped member longitudinally rearward to lock the grip body position. Additionally, during this replacement of the knife 39 into the sheathed position (i.e., converting the accessory 10 from the second mode back to the first mode), intermediate walls 248 and 310 on the respective side portions of the grip body prevent the grip body from accidentally being installed in reverse. If the grip body were attempted to be installed in reverse, the intermediate walls would block the prongs and prevent the prongs 108, 110 from engaging the pins 180, 184. This configuration may be beneficial when the blade is sharpened along one sharpened edge so that the sharpened edge faces forwardly and away from the operator of the firearm.

Figure 16:
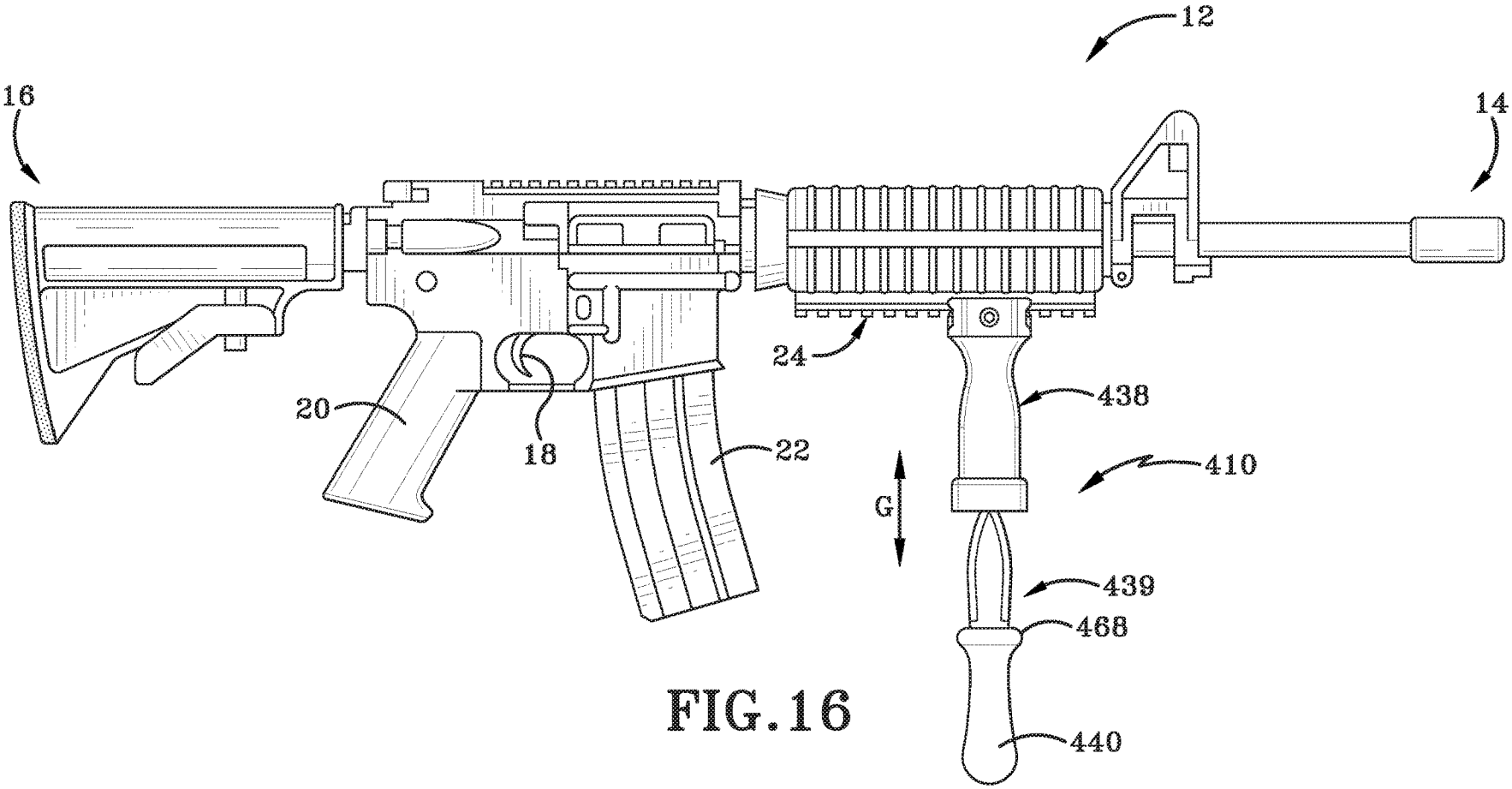
FIG. 16 is a side elevation view of an alternative embodiment of a firearm accessory embodied as a fixed blade knife attached to the firearm.

FIG. 16 depicts an operational embodiment of an alternative embodiment of a firearm accessory 410 in which the firearm accessory 410 comprises an attachment mechanism 438 and a fixed blade knife 439. In this situation, the fixed blade knife 439 fits within the attachment mechanism 438 coupled to the firearm 12 forwardly of the trigger 18. When the fixed blade knife 439 is received within the attachment mechanism 438, the tip of the fixed blade knife is positioned vertically upward and exterior the grip body 440. Similarly, when the knife 439 is extracted from the attachment mechanism 438, the tip of the fixed blade knife 439 is exterior the grip body 440 and vertically above the upper end 468 of the grip body 440. Thus, the alternative embodiment of a firearm accessory 410 additionally provides a fixed blade knife that is convertible between first and second modes that provide a sheathed position of the blade and an extended position of the blade wherein the tip of the blade is exterior the grip body 440 and vertically above the top end 468 of the grip body 440 in both the sheathed position and the extended position.

Figure 17:
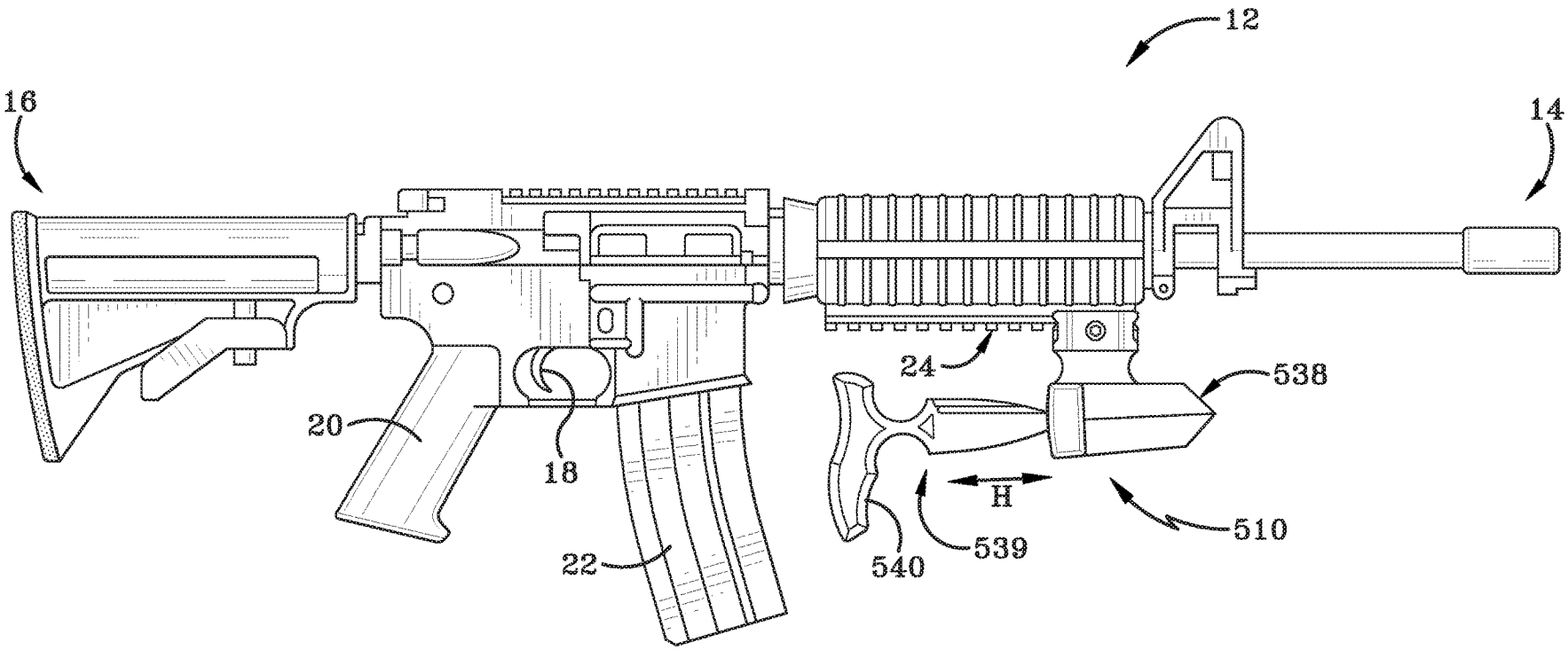
FIG. 17 is a side elevation view of another alternative embodiment of a firearm accessory embodied as a fixed blade knife attached to the firearm.

FIG. 17 depicts another alternative embodiment for a firearm accessory 510. Firearm accessory 510 comprises an attachment mechanism 538 and a fixed blade knife 539 that is configured to attach with the attachment mechanism 538 to position a blade of the fixed blade knife 539 forwardly of the trigger 18 on firearm 12. Firearm accessory 510 may define a vertical foregrip at the grip body 540 but may be inserted longitudinally as indicated by arrow H. When the fixed blade knife 539 is translated longitudinally forward as indicated by arrow H, the grip body 540 may still be generally vertical relative to the firearm 12 forwardly of the trigger 18. In order to release the fixed blade knife 539 from its frictional interference fit with the attachment mechanism 538, the user would pull the fixed blade knife 539 rearward in the longitudinal direction as indicated by arrow H to remove the fixed blade knife from its attachment with the attachment mechanism 538. Similar to the other embodiments, in both the first mode and the second mode of accessory 510, the tip of the blade is offset from and exterior to an upper end of the grip body 540.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, any method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clarity, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A method comprising:

grasping a grip body with an elongated member including a tip, the elongated member connected to the grip body in an extended position when the grip body is detached from a firearm, wherein the grip body has a first end and second end, wherein the elongated member extends outwardly from the first end of the grip body;

moving a tip on the elongated member towards an attachment mechanism coupled the firearm;

moving the tip through a portion of the attachment mechanism and continuing to apply a force to the grip body towards the attachment mechanism, wherein the force applied against the grip body causes the tip to pass through the portion of the attachment mechanism;

coupling the grip body to the firearm via the attachment mechanism forward of a trigger; and retaining the elongated member in a sheathed position within the attachment mechanism within which the tip on the elongated member remains offset from the first end and exterior the grip body, wherein the elongated member is installed in one position that precludes the elongated member from being attached to the attachment mechanism in a reverse direction.

2. The method of claim 1, wherein coupling the grip body to the firearm is accomplished by engaging at least one prong on the attachment mechanism with the grip body, wherein the tip of the elongated member is above the two prongs in the sheathed position.

3. The method of claim 2, further comprising:

moving the at least one prong in response to the upward force applied to the grip body.

4. The method of claim 3, further comprising:

engaging two prongs on the attachment mechanism with an element carried by the grip body, wherein one prong is offset to a first side of the elongated member and a second prong is offset to a second side of the elongated member.

5. The method of claim 1, wherein coupling the grip body to the firearm is accomplished by engaging two prongs on the grip body with the attachment mechanism, wherein the tip of the elongated member is vertically above the two prongs in the sheathed position.

6. The method of claim 1, further comprising:

flexing a liner lock inside the grip body, wherein the liner lock includes a plurality of weakening apertures.

7. A method comprising:

grasping a grip body having a first end and a second end, and connected to the grip body is an elongated member having a tip, wherein the elongated member extends outward from the first end and the tip is exterior the grip body when the elongated member and tip are in a sheathed position forwardly from a trigger inside an attachment mechanism coupled to a firearm when the grip body is coupled to the attachment mechanism, wherein the elongated member is installed in the sheathed position in one orientation that precludes the elongated member from being attached to the attachment mechanism in a reverse direction;

de-coupling the grip body from the attachment mechanism;

moving the tip through a portion of the attachment mechanism and continuing to apply a force to the grip body away from the attachment mechanism, wherein the force applied to the grip body causes the tip to pass through the portion of the attachment mechanism;

moving the tip on the elongated member away from the attachment mechanism that remains coupled to the firearm;

drawing the grip body away from the firearm such that the elongated member is in an extended position when the grip body is de-coupled from the firearm; wherein the elongated member extends outwardly from the first end of the grip body in the extended position, and the tip is exterior the grip body in the extended position.

8. The method of claim 7, wherein decoupling the grip body from the firearm is accomplished by disengaging at least one prong on the attachment mechanism from the grip body, wherein the tip of the elongated member is vertically above the two prongs in the sheathed position.

9. The method of claim 8, further comprising:

moving the at least one prong subsequent to the outward force applied to the grip body.

10. The method of claim 9, further comprising:

disengaging two prongs on the attachment mechanism from a portion of the grip body, wherein one prong is offset to a first side of the elongated member and a second prong is offset to a second side of the elongated member.

11. The method of claim 7, wherein decoupling the grip body to the firearm is accomplished by disengaging two prongs on the grip body with the attachment mechanism, wherein the tip of the elongated member is above the two prongs in the sheathed position.

12. The method of claim 7, further comprising:

flexing a liner lock defining a plurality of weakening apertures inside the grip body to move from an unlocked position into a locked position in which the liner lock engages the elongated member adjacent a lower end thereof in the extended position.

13. A firearm accessory comprising:

a grip body having a first end and a second end, wherein the grip body is adapted to operate in two modes: a first mode as a foregrip when the grip body is at least indirectly coupled to a firearm forwardly of a trigger and a second mode as a knife when the grip body is disconnected from the firearm;

a blade coupled to the grip body, wherein the blade includes a tip, wherein the tip is exterior the first end of the grip body in both the first mode and the second mode;

a coupler adapted to be coupled with the firearm; and two members that connect the grip body and the coupler when the grip body is in the first mode as a foregrip forwardly of the trigger, and the two members are disconnected relative to the grip body and the coupler when the grip body is in the second mode as a knife detached from the firearm;

wherein the blade is installed in one position orientation that precludes the blade from being attached to the coupler in a reverse direction.

14. The firearm accessory of claim 13, wherein the two members are a first prong and a second prong.

15. The firearm accessory of claim 14, wherein the first prong and the second prong are extend downwardly from the coupler when the coupler is coupled to the firearm forwardly of the trigger.

16. The firearm accessory of claim 13, further comprising:

a magnet within the coupler adapted to be attracted to the blade when the grip body is in the first mode and the magnet adapted to assist the blade to transition between the first and second modes.

17. The firearm accessory of claim 16, further comprising:

an insert formed from an elastomeric material defining a blade contact section adapted to contact the blade at or near the tip when the grip body is in the first mode; and a recess defined by the insert, wherein the magnet is disposed within the recess.

18. The firearm accessory of claim 16, further comprising:

at least one liner lock within the grip body adapted to lock the blade in an extended position in the second mode.

19. The firearm accessory of claim 18, wherein the at least one liner lock is formed with a plurality of weakening apertures adapted to increase the flexibility of the liner lock.

20. The firearm accessory of claim 13, wherein the blade is fixedly connected relative to the grip body.

* * * * *